US010661929B2

(12) United States Patent
Gebbink et al.

(10) Patent No.: US 10,661,929 B2
(45) Date of Patent: May 26, 2020

(54) ASSEMBLY AND METHOD FOR STORING CONTAINERS

(71) Applicant: Fuji Seal International, Inc., Osaka-shi, Osaka (JP)

(72) Inventors: Jeroen Gerrit Anton Gebbink, Helmond (NL); Stijn Antonius Petrus Verhoeven, Bakel (NL)

(73) Assignee: Fuji Seal International, Inc., Osaka-shi (JP)

( * ) Notice: Subject to any disclaimer, the term of this patent is extended or adjusted under 35 U.S.C. 154(b) by 301 days.

(21) Appl. No.: 15/118,601

(22) PCT Filed: Feb. 26, 2015

(86) PCT No.: PCT/EP2015/054052
§ 371 (c)(1),
(2) Date: Aug. 12, 2016

(87) PCT Pub. No.: WO2015/128427
PCT Pub. Date: Sep. 3, 2015

(65) Prior Publication Data

US 2017/0043891 A1 Feb. 16, 2017

(30) Foreign Application Priority Data

Feb. 26, 2014 (NL) ..... 2012330
May 15, 2014 (NL) ..... 2012820

(51) Int. Cl.
*B65D 85/00* (2006.01)
*B65B 43/12* (2006.01)
(Continued)

(52) U.S. Cl.
CPC ..... *B65B 43/12* (2013.01); *B31B 70/98* (2017.08); *B65B 43/14* (2013.01); *B65D 71/08* (2013.01);
(Continued)

(58) Field of Classification Search
CPC .... B65D 71/08; B65D 71/50; B65D 75/5883; B65D 85/62; B65B 43/12; B65B 43/14; B31B 70/98; B31B 2160/10
(Continued)

(56) References Cited

U.S. PATENT DOCUMENTS 3,111,221 A * 11/1963 Chapman ..... B65D 71/10 206/147
3,243,220 A 3/1966 Karas
(Continued)

FOREIGN PATENT DOCUMENTS

JP 05170252 A 7/1993
JP 10194328 A 7/1998
(Continued)

OTHER PUBLICATIONS

"International Application No. PCT/EP2015/054052, International Search Report dated Jul. 5, 2015", 6 pgs.
(Continued)

*Primary Examiner* — Luan K Bui
(74) *Attorney, Agent, or Firm* — Schwegman Lundberg & Woessner, P.A.

(57) ABSTRACT

The invention relates to an assembly for storing a plurality of flexible containers (1) with dispensing spouts, the assembly comprising one or more elongated guiding elements (15) configured to carry rows of dispensing spouts, wherein the guiding elements (15) are configured to be maintained in a substantially tubular arrangement while storing the containers in the interior formed by the tubular arrangement. The guiding elements (15) may be straight elements arranged in a parallel manner to form a tube-like arrangement. The guiding elements are also arranged to allow the containers to
(Continued)

be attached in such a manner that they are positioned along a generally helical trajectory in the interior of the tubular arrangement.

15 Claims, 24 Drawing Sheets

(51) Int. Cl.

| | |
|---|---|
| ***B65D 71/50*** | (2006.01) |
| ***B65D 75/58*** | (2006.01) |
| ***B65D 85/62*** | (2006.01) |
| ***B65B 43/14*** | (2006.01) |
| ***B31B 70/98*** | (2017.01) |
| ***B65D 71/08*** | (2006.01) |
| *B31B 160/10* | (2017.01) |

(52) U.S. Cl.
CPC ..... *B65D 71/50* (2013.01); *B65D 75/5883* (2013.01); *B65D 85/62* (2013.01); *B31B 2160/10* (2017.08)

(58) Field of Classification Search
USPC ..... 206/363, 427, 497, 504, 558, 820; 220/4.21–4.24, 4.28, 23.2, 23.4, 23.83; 294/87.2, 87.28; 211/71.01, 81, 85.15
See application file for complete search history.

(56) References Cited

U.S. PATENT DOCUMENTS 3,295,710 A * 1/1967 Marchant ..... B29C 49/04 206/162
4,415,085 A 11/1983 Clarke et al.
5,695,075 A * 12/1997 Flum ..... A47F 1/12 211/59.2
5,706,956 A * 1/1998 Headrick ..... A47F 1/12 211/59.2
5,706,957 A * 1/1998 Hardy ..... A47F 1/12 211/59.2
5,971,167 A * 10/1999 Finbow ..... A47G 23/0208 206/426
6,059,125 A * 5/2000 Parham ..... A47B 73/00 211/162
6,360,901 B1 * 3/2002 Parham ..... A47F 7/285 211/162
7,810,667 B2 * 10/2010 Douglas ..... B65B 43/123 206/390
8,490,662 B2 7/2013 Murray
2009/0308023 A1 * 12/2009 Wada ..... B65D 75/5883 53/133.2

FOREIGN PATENT DOCUMENTS

| | | | |
|---|---|---|---|
| JP | 2001315843 | A | 11/2001 |
| JP | 2011018158 | A | 1/2011 |
| RU | 2004113948 | A | 2/2005 |
| RU | 2004139103 | A | 7/2005 |
| WO | WO-2012028980 | A1 | 3/2012 |
| WO | WO-2014171834 | A3 | 10/2014 |

OTHER PUBLICATIONS

"International Application No. PCT/EP2015/054052, Written Opinion dated Jul. 5, 15", 6 pgs.
"Japanese Applicccation Serial No. 2016-551766, Notification of Refusal dated Mar. 5, 2019", w/ English Translation, (dated Mar. 5, 2019), 14 pgs.
"Japanese Application Serial No. 2016-551766, Notice of Refusal dated May 23, 2019", (dated May 23, 2019), 6 pgs.
"European Application Serial No. 15 708 160.5, Office Action dated Apr. 4, 2017", (Apr. 4, 2017), 7 pgs.
"Russian Application Serial No. 2016138074/13 Office Action dated Jul. 27, 2018", (Jul. 27, 2018), 2 pgs.

* cited by examiner

ASSEMBLY AND METHOD FOR STORING CONTAINERS

PRIORITY APPLICATIONS

This application is a U.S. National Stage Filing under 35 U.S.C. 371 from International Application No. PCT/EP2015/054052, filed on 26 Feb. 2015, and published as WO 2015/128427 on 3 Sep. 2015, which claims the benefit of priority to Netherlands Application No. 2012820, filed on 15 May 2014 and to Netherlands Application No. 2012330, filed on 26 Feb. 2014; which applications and publication are incorporated herein by reference in their entirety.

The invention relates to an assembly, guiding element and a method for storing a plurality of flexible containers, in particular to an assembly comprising one or more elongated guiding elements configured to carry one or more rows of containers.

Flexible containers for keeping fluid or dry products, such as a liquid, granular material, powder or the like, are known in the art. One example of a flexible container is a flexible pouch, for instance comprising a laminate composed of sheets of plastic or the like. For instance, a pouch may be made of a front and back wall comprising one or more flexible film, facing one another and joined, for example welded, along their edges. The container has an opening means for access the contents of the container. The opening means may be a spout sealed to the upper part of the flexible pouch, between the front and back wall. The opening can be sealed off, for instance by a removable screw cap, and may even provide for resealing the pouch after it has been opened. Examples of such flexible pouches are described in US2009308023 A1.

Flexible containers may be manufactured at a location that differs from the location at which the containers are filled with products, for instance foodstuff. For instance, the containers may be manufactured at a first location, packed and then transported to a second location where they are unpacked. In order to transport the packed containers, they are loaded into a truck or other transport vehicle and at its destination (i.e. at the second location) the truck needs to be unloaded again. At the second location, for instance the location wherein the foodstuff is available, the unloaded and unpacked containers are filled with content and then transported further.

In order to transport the containers, they are arranged in elongated guiding element or rails by sliding the spouts of the containers along the rail to form a row of containers. One or more of these rails provided with containers are packed, for instance using liners and carton boxes, and then transported by trucks to the second location. At the second location, the packaging material needs to be removed and the individual rails (guiding elements) each of which has a row of containers, is arranged in a filling machine which is configured to fill the individual containers.

This way of handling the containers has a number of disadvantages. First of all, the guiding elements (rails) with pouches need to be packaged using packaging material like liner and cardboard boxes. This material needs to be removed again once the containers have arrived at the second location. This is labour extensive, requires a relatively large amount of packaging material and produces waste in the form of used packaging material. Furthermore, under specific circumstances, for instance when the spouts are to be handled in so-called clean rooms or clean environment, with a low level of environmental pollutants such as dust, airborne microbes, aerosol particles, and chemical vapours. Under these circumstances it is not always allowable to employ specific types packaging materials, like cardboard or similar materials.

Furthermore, the containers arranged in the guiding elements occupy a relatively large volume and therefore the cost for temporarily storing the packaged containers and transporting them are relatively high.

Accordingly, it is an object of the invention to have an assembly and method for storing flexible containers wherein at least one of the above identified and/or other disadvantages has been reduced.

It is an object of the invention to provide an assembly and method for storing flexible containers wherein the containers may be processed (for instance, filling the rails or emptying the rails) in an easy and automated manner.

It is furthermore an object of the invention to provide an assembly and a method for safely storing flexible containers, and/or wherein the containers may be easily protected during the storage and/or transport phase after the containers have been arranged in the guiding elements. It is also an object of the invention to provide an assembly and method wherein the containers can be stored and/or transported in an easy and/or an efficient manner.

At least one of these objects is achieved in an assembly and method as claimed in the annexed claims.

According to a first aspect of the invention, an assembly for storing a plurality of flexible containers is provided, the assembly comprising one or more elongated guiding elements configured to carry rows of flexible containers, wherein the guiding elements are configured to be maintained in a substantially tubular arrangement while storing the containers in the interior formed by the tubular arrangement. The guiding elements are configured to be maintained in a substantially tubular arrangement while storing the containers in the interior formed by the tubular arrangement. By arranging the guiding elements in a tubular arrangement it is possible to keep the containers inside the interior confined by the tubular arrangement. In this way the containers may be protected by the guiding elements, for instance during transport and/or storage. By making use of the guiding elements for protection of the containers, a separate packaging step may be dispensed with or may be simplified. This facilitates the handling of the containers, both at the location of origin (for instance a plant for manufacturing containers) and at the location of destination (for instance a plant for filling the containers with foodstuff).

The flexible containers may be containers made from flexible film material, such as flexible film pouch. Furthermore, a container may be provided with a dispensing spout forming the neck of the container and enabling an empty container to be filled or a filled container to be emptied. The guiding elements may be configured to carry the dispensing spouts of the containers. However, in other embodiments of the invention the guiding elements are configured to carry another portion of the container.

In embodiments of the invention the guiding elements are configured to be arranged in a cylindrical arrangement (for instance a circular cylinder, elliptic cylinder, parabolic cylinder, hyperbolic cylinder or rectangular cylinder, having a cross-section defined by a circle, ellipse, parabola, hyperbola, rectangle respectively, or, more generally, an n-gonal prism where n ranges from 3 to ∞). Furthermore, the guiding elements are arranged in a substantially tubular arrangement, which means that they do not need have to form a closed circumference. In embodiments of the invention the guiding elements form an open circumference, for instance having an opening along the full length of the tubular arrangement.

In embodiments of the invention the guiding elements are configured to allow them to be positioned in a protective arrangement wherein the guiding elements fully envelop the containers. In other embodiments the guiding elements only partly cover the flexible containers, for instance when the guiding elements only partly surround the containers.

In embodiments of the invention only one guiding element is employed. For instance, when the guiding element is bendable, it may be arranged to form a helical trajectory. When the guiding element is arranged in a helical shape, it constitutes a tubular arrangement inside which a row of containers may be safely held.

In other embodiments the assembly comprises a plurality of elongated guiding elements onto which a plurality of rows of dispensing spouts can be carried. The plurality of guiding elements may be arranged side-by-side at an inner surface of a tubular element, for instance by mounting the guiding elements inside the tube element, integrally forming the guiding elements with the tubular element or by arranging the guiding elements freely in the tube (i.e. without attaching the guiding elements to the tubular element). In the latter case the guiding elements may be mutually coupled (interconnected), as described hereafter. Preferably, the tubular element is made of flexible material allowing the guiding elements to be moved between the tubular arrangement and any other arrangement, for instance flat arrangement wherein the guiding elements extend in a flat plane. In the tubular arrangement the containers are protected by the guiding elements (for instance during the storage or transport phase), whereas in the non-tubular arrangement the containers may be handled more easily (for instance during the filling phase).

According to embodiments of the invention each of the plurality of guiding elements may be arranged in a helical shape, so that a plurality of helical rows of containers in the tubular arrangement is created. In other embodiments, the guiding elements are straight elements arranged in a parallel manner. Also the straight guiding elements allow the containers to be attached in such order that they extend along a generally helical trajectory in the interior of the tubular arrangement, as will be explained hereafter.

Both the embodiments with only one guiding element and embodiments with a plurality of guiding elements allow stacking of the containers in the interior of the tubular arrangement. The stacking can be done either in an overlapping or in a non-overlapping manner In both cases a relatively large amount of containers may be safely stored in a relatively small, substantially tubular volume. This is beneficial from the point of view of costs for transport and storage and/or facilitates handling of the containers and/or reduces or even removes the need for packaging materials.

As described above the guiding elements may be mutually coupled (interconnected). In embodiments of the invention the interconnection is accomplished in that the guiding elements are provided with one or more coupling elements. The coupling elements may be configured to releasably couple abutting guiding elements so that the guiding elements may be decoupled, for instance when the guiding elements need to be handled by a filling machine. In embodiments of the invention the one or more coupling elements are configured to allow the guiding elements to be moved from the tubular arrangement to a non-tubular arrangement, for instance a substantially flat arrangement. In a specific embodiment a guiding element comprises a first coupling element (for instance a male element) arranged at a first side and a second coupling element (for instance a female element) arranged at a second side, opposite the first side. The first (male) and second (female) elements may engage on one another in order to couple the guiding elements. The first and second coupling elements may be configured to provide a snap connection. This means that the guiding elements can be easily coupled or decoupled by snapping action. Any other type of coupling is conceivable as well.

In a further embodiment the coupling elements are configured to decouple abutting guiding elements by movement of one or both of the guiding elements in a direction substantially perpendicular to the longitudinal direction of the guiding elements. No substantial movement in another direction is needed to be able to decouple the guiding elements. This has the advantage that the guiding elements may be decoupled and then separately processed even when they are filled with containers, the containers being interwoven to some extent in the tubular arrangement.

Preferably the coupling elements allow the associated guiding elements to be coupled in a pivotable manner In this way the guiding elements may be pivoted relative to one another to fold or unfold the arrangement of guiding elements. For instance, the plurality of guiding elements may be configured to be pivotable between a storage position in which the guiding elements extend in the substantially tubular arrangement and an operating position in which the plurality of guiding elements extend in a slightly curved or flat plane.

In other embodiments of the invention the coupling element comprises a carrier sheet. The carrier sheet may be made of rigid material or, preferably, of flexible material. A plurality of guiding elements is attached to or integrally formed with one side of the carrier sheet. The sheet interconnects the guiding elements. In case the sheet is made of flexible material, the sheet enables the guiding elements to be moved between different arrangement, i.e. between the tubular arrangement and a non-tubular arrangement, for instance a substantially flat arrangement. For instance, the flexible sheet material between neighbouring guiding elements may act as pivot element so that the guiding elements may be pivoted relative to each other. In other embodiments the coupling elements are formed by pieces of flexible material mounted between neighbouring guiding elements, the flexible material enabling the guiding elements to be pivoted relative to each other.

In the tubular position the guiding elements may provide protection to the containers in a radial direction. In an axial direction the tubular arrangement remains open and therefore the first (couple of) containers and the last (couple of) containers may be affected in axial directions. In order to protect the interior of the tubular arrangement in the axial directions as well, the assembly may comprises a first cover element and/or a second cover element, wherein the cover elements are removably attached to opposing free ends of the guiding elements. The cover elements may be end caps that are clampingly attached to the ends of the guiding elements. For example, the cover elements are made of more or less rigid material shaped to conform to the shape of the outer ends of the tubular arrangement so that the end caps may be attached to the guiding elements by sliding them over the outer ends.

In other embodiments the interior of the tubular arrangement of guiding elements is protected by a sleeve, for instance an elastic sleeve or, preferably, a shrink sleeve, arranged around the guiding elements. The sleeve may be applied around the tubular arrangement to partly or, preferably, fully cover the assembly. A shrink sleeve shrunk around the tube formed by the guiding elements (for instance in a heat shrink process), not only provides excellent protection of the interior of the assembly against external influences and enables the containers to remain clean, but also provides a means to prove that the containers have not been tampered with.

Returning to the above-described cover elements for covering the ends of the tubular arrangement, the cover elements may be configured to allow stable placement of the assembly on a flat support surface. Examples of a flat support surface are a floor, loading platform, pallet and the like. In a further embodiment the cover elements are configured to allow the cover elements of a first assembly of guiding elements to be stably placed on the cover elements of a second assembly of guiding elements. In this configuration the tubular assemblies may be stacked simply by placing on assembly on the other. This facilitates the storage and transport of the assemblies. Especially when the assemblies are placed on a pallet or similar displaceable support platform, a large number of containers can picked up and placed in a vehicle in a fast and reliable manner. An example of cover elements providing this functionality is when the cover elements have an essentially polygonal cross-section. The straight sides of the polygon provide for a stable placement of the assembly on any flat surface, for instance a platform or a straight side of a polygonal cover element of another assembly.

When the assemblies have been emptied, for instance when all containers have been removed to be filled by the filling machine, the remaining guiding elements may be collapsed, collected and reused for a further set of containers. In embodiments of the invention the cover elements are configured to render the assembly stackable and/or collapsible when empty.

The guiding elements are configured to carry a row of flexible containers. In embodiments of the invention the guiding elements are elongated sections having an essentially U-shaped cross-section. Each of the longitudinal free edges of the U-shaped section comprises a flange part extending inwardly to guide and support one or more spouts of a corresponding number of containers. Furthermore, each of the longitudinal free edges of the U-shaped section has a coupling element extending outwardly for coupling with one or more neighbouring guiding elements.

According to another aspect of the invention a guiding element is provided, the guiding element comprising coupling elements arranged to mutually couple to neighbouring guiding elements. The guiding element may comprise a first coupling element arranged at a first side and a second coupling element at a second side, opposite the first side, wherein the first coupling element of a guiding element is configured to engage on a second coupling element of another coupling element. According to an embodiment the coupling elements are arranged at positions recessed relative to the maximum width (w) of the guiding element. Preferably the coupling elements are positioned so that the distance between the first coupling element and second coupling element of a guiding element is smaller than the maximum width (w) of the guiding element. This enables the width of the guiding element to be relatively large (which may be advantageous when the guiding elements are to handled by standard equipment requiring a relatively large width of the guiding element to be gripped properly) while the pitch between the coupling elements can be kept relatively small, which increases the storage capacity of the assembly (i.e. increases the number of containers that can be stored in the tubular arrangement). A further advantage is that relative to the pitch the guiding element is wide and therefore may provide improved protection for the containers stored in the interior of the tubular arrangement. In a preferred embodiment the sides (side walls) of the guiding elements are generally S-shaped in cross section. Other shapes in cross-section may be useful as well, such as side walls forming a square-wave, sine wave, etc.

The flexible container may be shaped so that it can be easily be stored in an assembly as described herein. The flexible container may be of a type comprising two or more walls of flexible material, the walls facing one another and joined along their edges, one edge being provided with a dispensing spout. In order to be properly accommodated in the interior of the tubular arrangement of guiding elements the joined edges of the walls of the container next to the dispensing spout have a generally curved concave shape, the concave shape of the spout corresponding to the inner contour of the tubular arrangement.

The invention also relates to the use of an assembly of one or more guiding elements, preferably the assembly as defined herein, for storing a plurality of flexible containers, comprising maintaining the one or more guiding elements in a substantially tubular arrangement and inserting one or more rows of flexible containers into the one or more guiding elements.

According to another aspect of the invention a method of storing a plurality of flexible containers is provided. The containers may have dispensing spouts and are configured according to the specifications described herein. The method comprises positioning one or more guiding elements so as to form a substantially tubular arrangement, wherein the guiding elements are arranged to store the containers in the interior formed by the substantially tubular arrangement. The method may comprises mutually connecting a plurality of guiding elements and then displacing the guiding elements, for instance pivoting or folding the same, into a substantially tubular arrangement. Once the guiding elements have been placed in the tubular arrangement, the method comprises moving the plurality of flexible containers into the tubular arrangement. The method may comprise:

a) positioning a first container in front of a first guiding element of a plurality of guiding elements placed in a tubular arrangement;

b) guiding the first container, for instance the spout of the first container, into the first guiding element;

c) positioning a further container in front of a further guiding element, the further guiding element;

d) guiding the further container, for instance the spout of the further container, into the further guiding element;

e) repeating the guiding of further containers into a guiding element for all containers.

According to another aspect a method of removing flexible containers from the assembly defined herein is provided, the method comprising:

a) guiding a container from one of the plurality of guiding elements out of the guiding element;

b) guiding a further container from another one of the plurality of guiding elements out of the guiding elements;

c) repeating the guiding of further containers from a guiding element until all containers have been removed.

Further characteristics of the present invention will be elucidated in the accompanying description of various preferred embodiments thereof. In the description reference is made to the annexed figures.

Figure 14B:
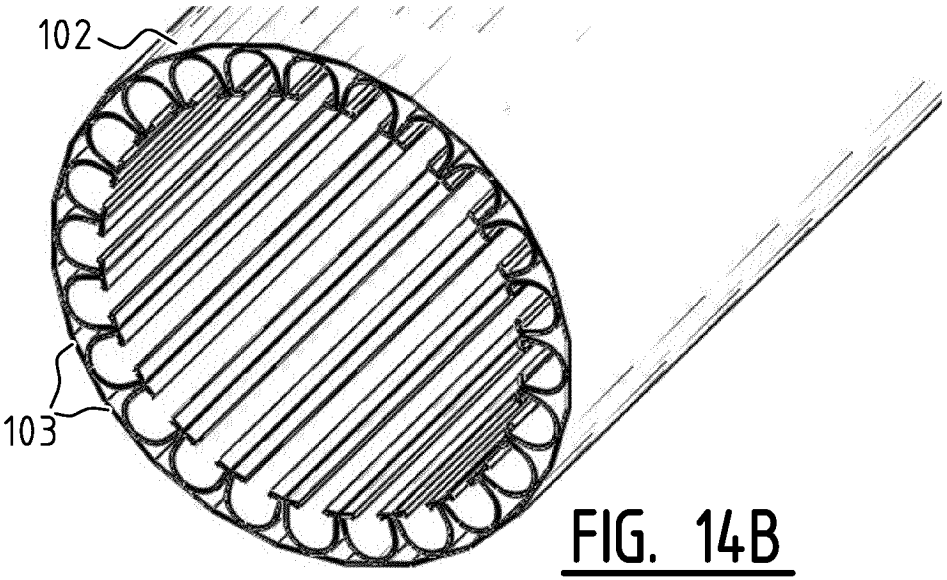
FIGS. 14A and 14B are views of a further embodiment, in flat and tubular arrangement, respectively.
Figure 14A:
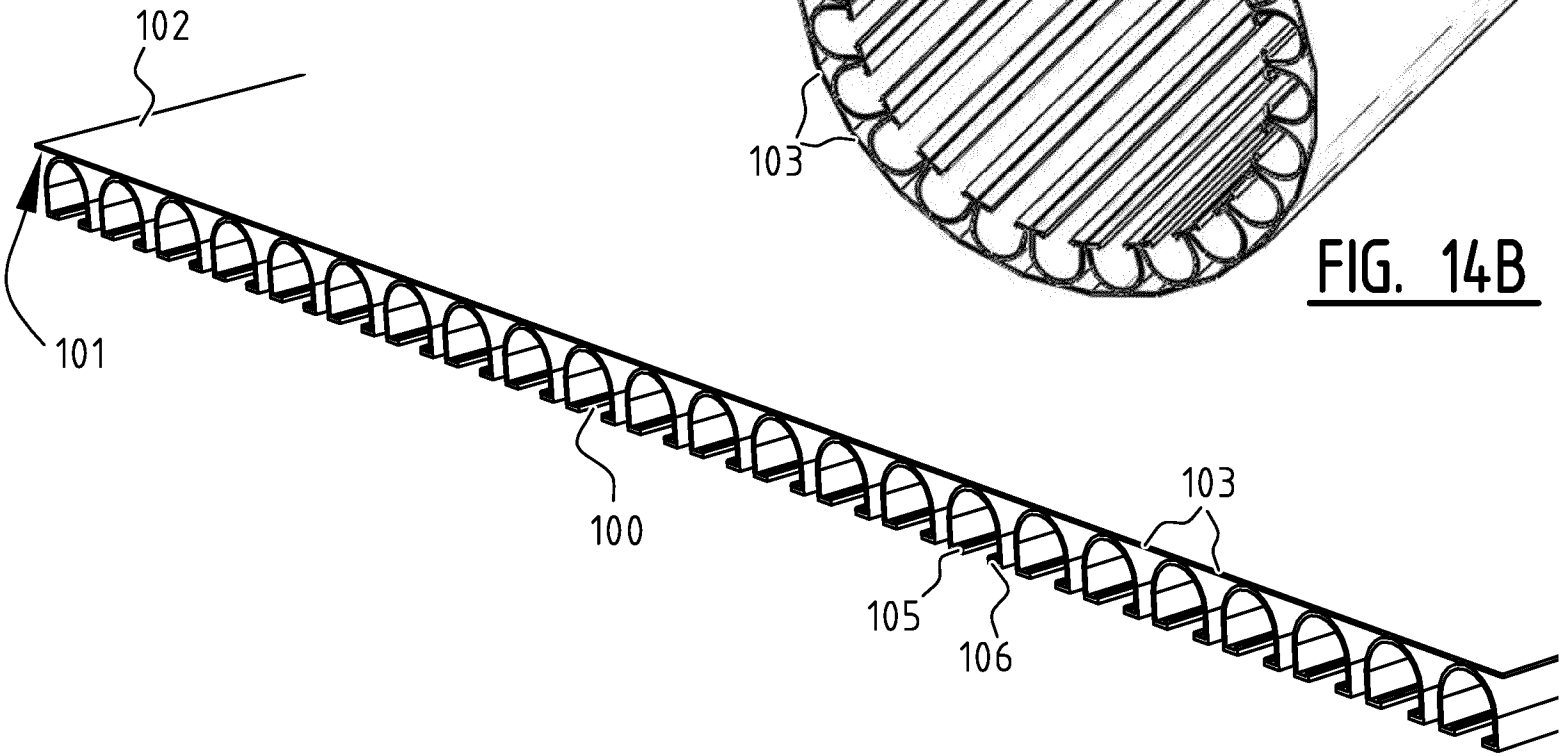
Figure 15:
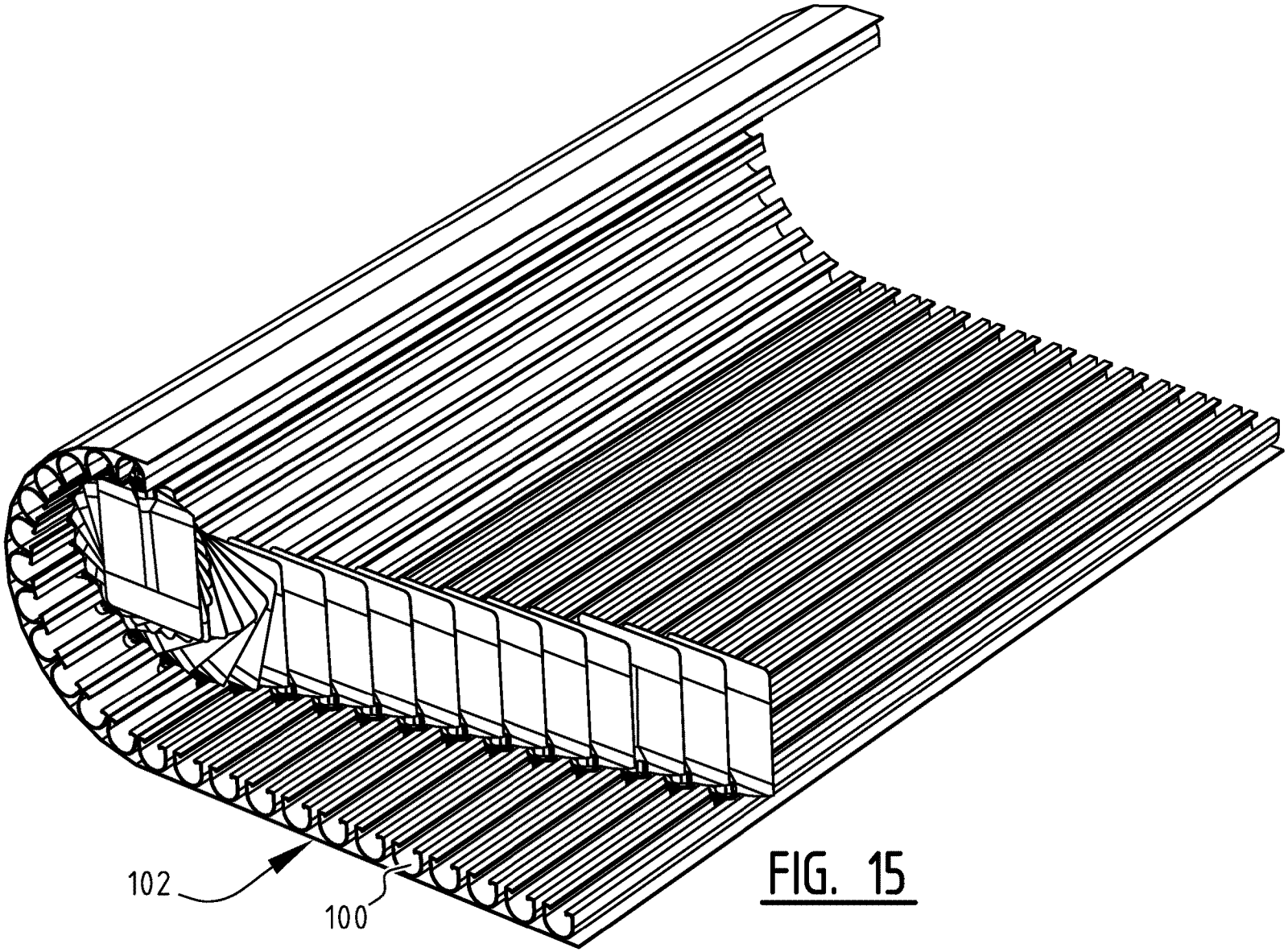
Figure 16:
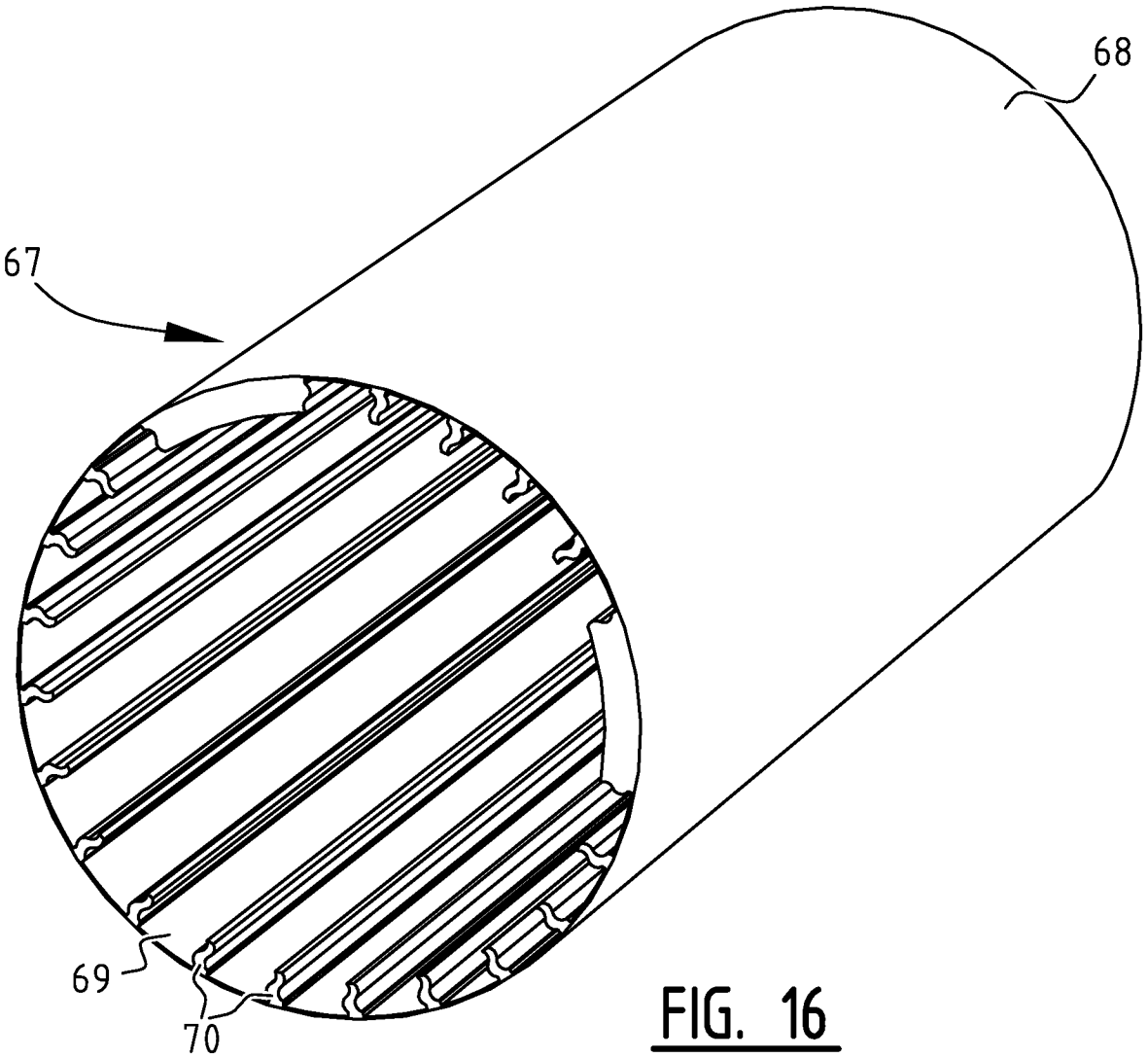
Figure 17:
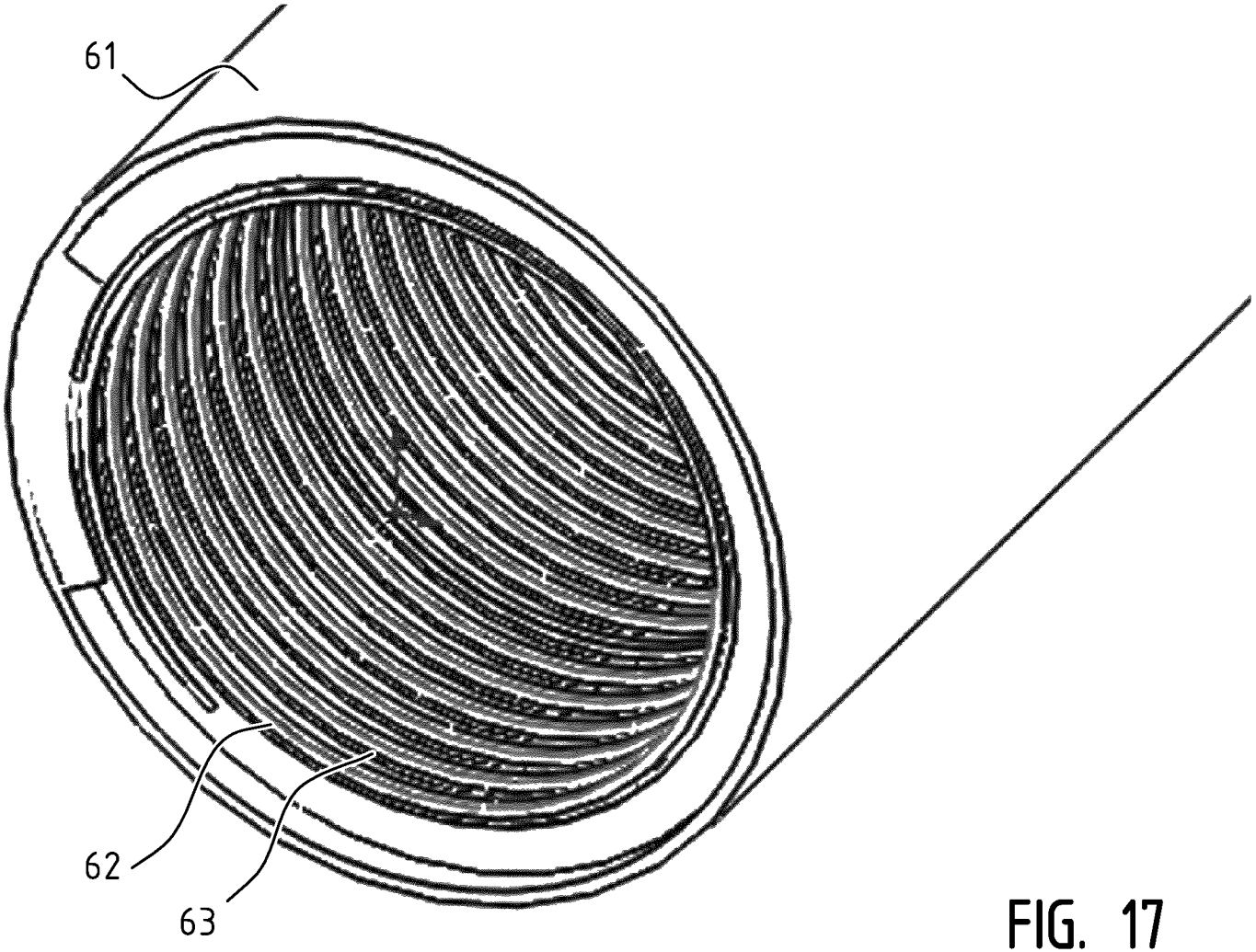

FIG. 15 a view in perspective of the embodiment of FIG. 14, partially in tubular arrangement and partially in flat arrangement;

FIG. 16 is a view in perspective of an embodiment of a preparation device showing receiving elements for attachment of guiding elements;

FIG. 17 is a view in perspective of a further embodiment of the invention, wherein a helical guiding element is formed at the inner surface of a tubular element;

FIGS. 18-24 are views in perspective of respective further embodiments of the invention.

Figure 1:
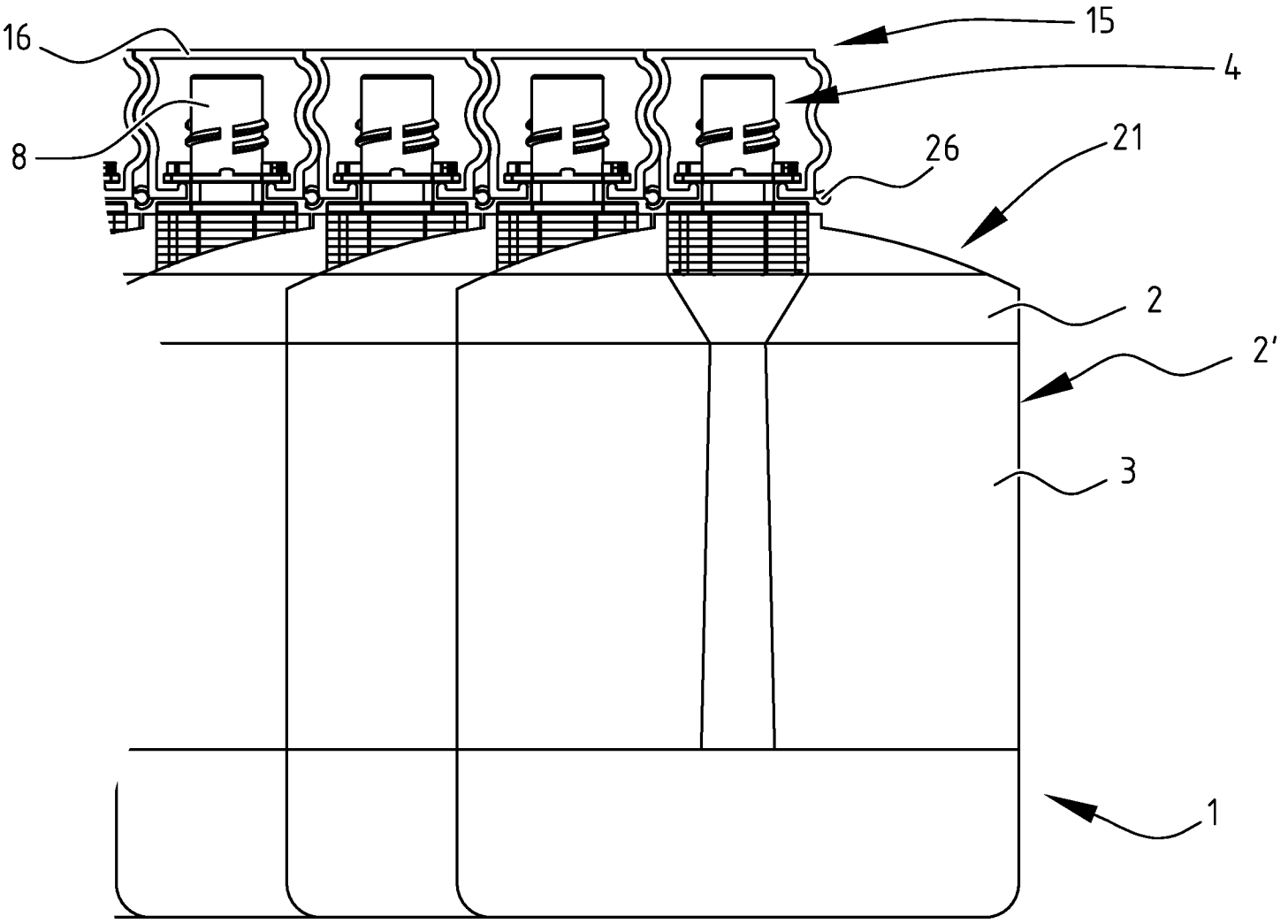
FIG. 1 is a schematic view of an exemplifying container used in an assembly according to an embodiment of the present invention.

FIG. 1 shows a pouch container 1 (herein also referred to as a pouch), comprising a front wall 2 and a back wall 2', both walls being made of thin, flexible film material, preferably plastic film material. The walls 2, 2' are sealed along their circumferential edges 3 to form a package for flowable products, for example foodstuff, cosmetics, medicines, etc. In the upper edge of the pouch 1 a dispensing element, herein also referred to as a (dispensing) spout 4, is arranged.

Figure 2:
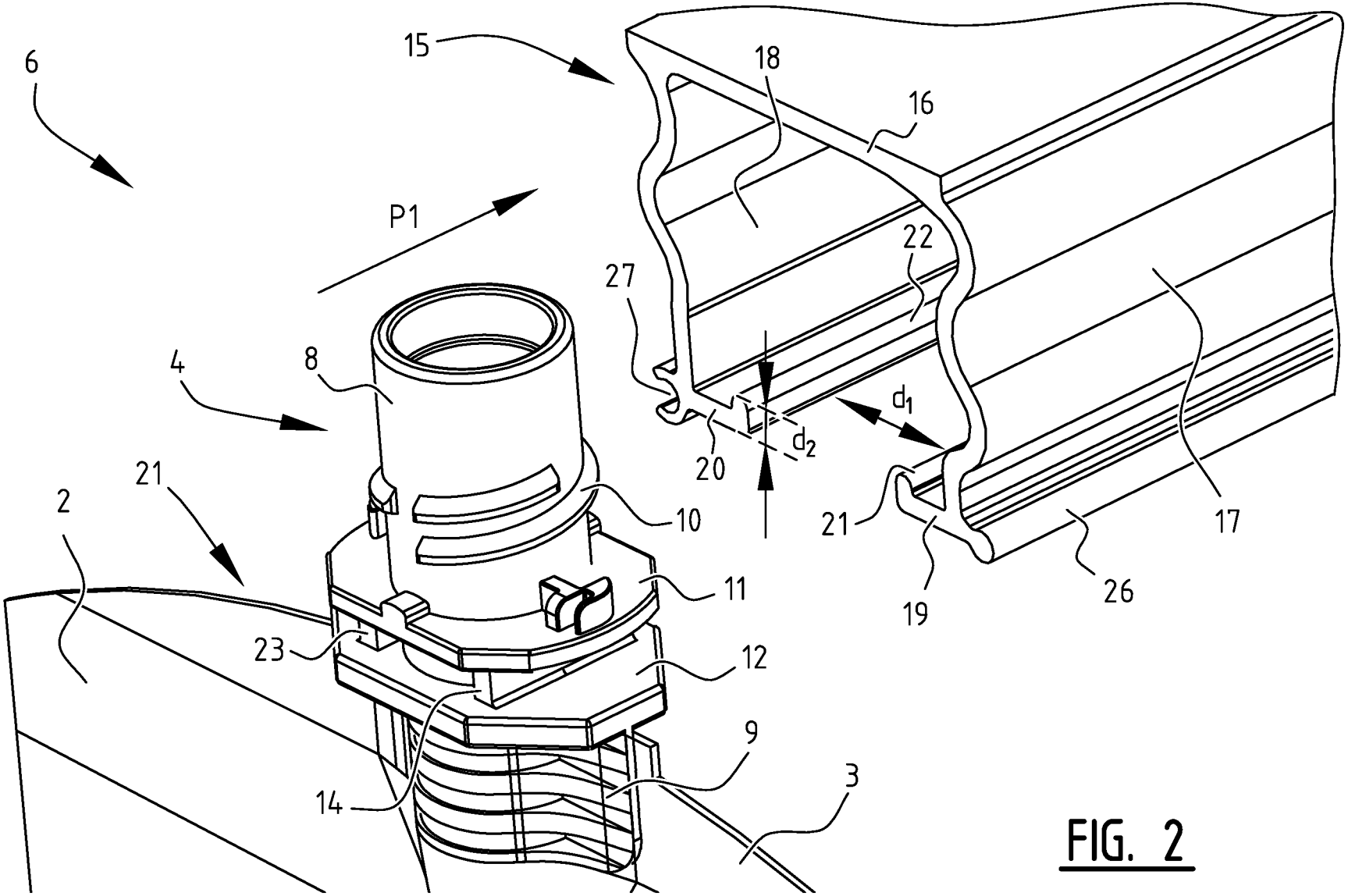
FIG. 2 is a combination of the container of FIG. 1 and an embodiment of a guiding element.

Referring to FIG. 2, the spout 4 of the pouch 1 comprises an elongated dispensing tube 8. The upper end of the dispensing tube 8 is provided with thread windings 10 for attaching a removable end cap (not shown) on the pouch 1 after it has been filled. The lower end of the dispensing tube 8 extends through the upper circumferential edge 3 and extends into the interior thereof so that the dispensing tube 8 may provide a fluid connection between the interior of the pouch and its surroundings so that the content of the pouch may be dispensed when the end cap is removed. The dispensing tube 8 is provided with two lateral elements which serve to attach the pouch 1 to a guiding element 15. More specifically, the dispensing tube 8 comprises an upper flange part 11 and a lower flange part 12.

Guiding rail or guiding element 15 is an elongated section comprising an upper section part 16, a first section side part 17 and a second section side part 18, both section side parts extending roughly orthogonally with respect to the upper section part. At the free ends of the section side parts 17, 18 a slotted carrier part for carrying the spout of a spouted pouch is provided. The carrier part comprises inwardly extending section flanges 19, 20 forming a slot between the free ends of the flanges. The distance ($d_1$) between the section flange 19 of the section side part 17 and section flange 20 of the section side part 18 is slightly larger than the distance between upright walls 14,23 of the spout and smaller than the width between the upper flange part 11 and lower flange part 12 of the spout 4. Furthermore the section flanges 19, 20 are provided at their respective outer ends with longitudinal ridges 21, 22 along which the upper flange part 11 of the dispensing element (spout 4) of the pouch 1 can be slid. The distance between the upper flange part 11 and the lower flange part 12 of the spout 4 is slightly larger than the distance $d_2$ between the top and bottom of a longitudinal ridge 21,22 and such that the longitudinal ridges 21, 22 are properly maintained between the upper flange part 11 and lower flange part 12. Therefore the pouch 1 can be moved easily into the guiding element 15 by sliding the spout 4 smoothly (in direction $P_1$) to be stably maintained within the guiding element by the both flange parts 11, 12 of the spout and the section flanges 19, 20 of the guiding element 15. The number of pouches 1 that can be arranged in the guiding element 15 depends amongst others on the length of the guiding element and the dimensions of the respective spouts 4 of the pouches. As a not limiting example a typical guiding element may carry between 50 and 60 pouches.

Figure 3B:
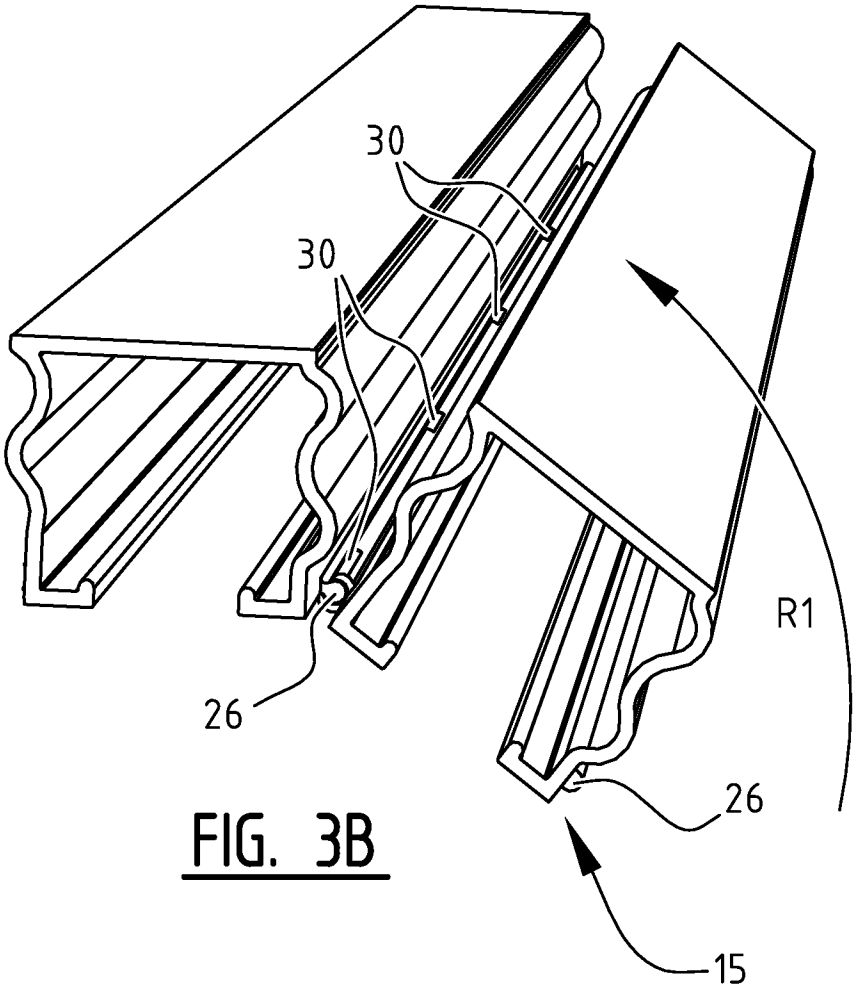
FIGS. 3A and 3B are perspective views of the guiding elements in disconnected and connected condition, respectively.
Figure 3A:
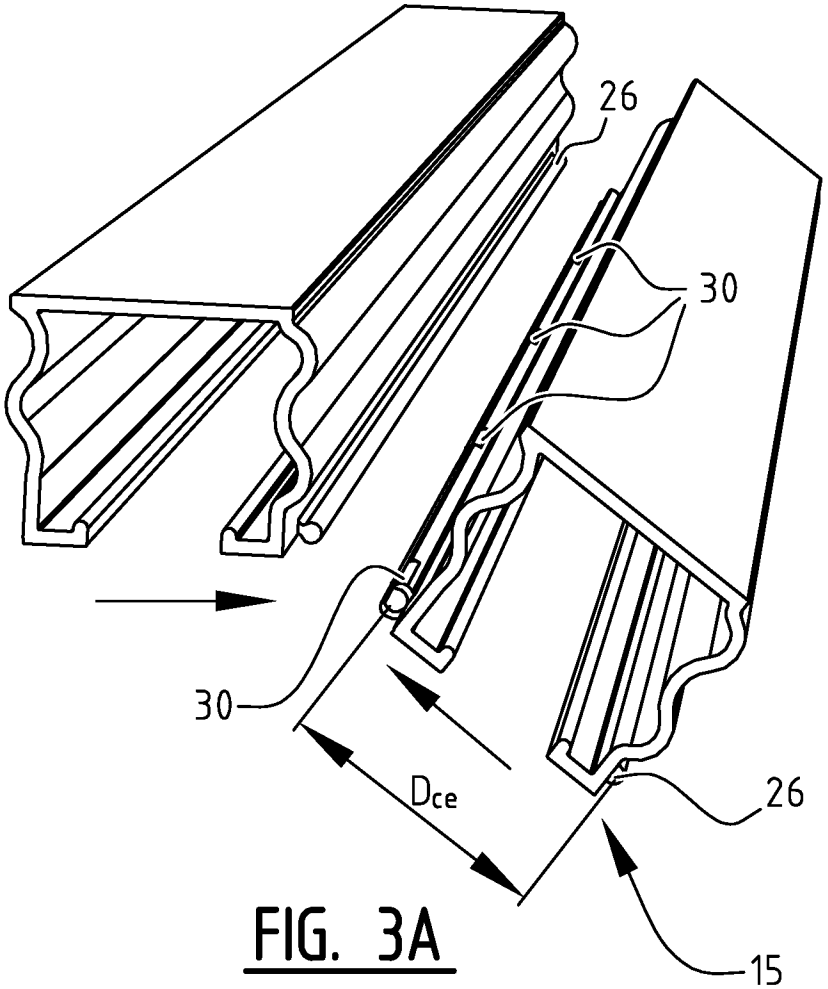
Figure 5:
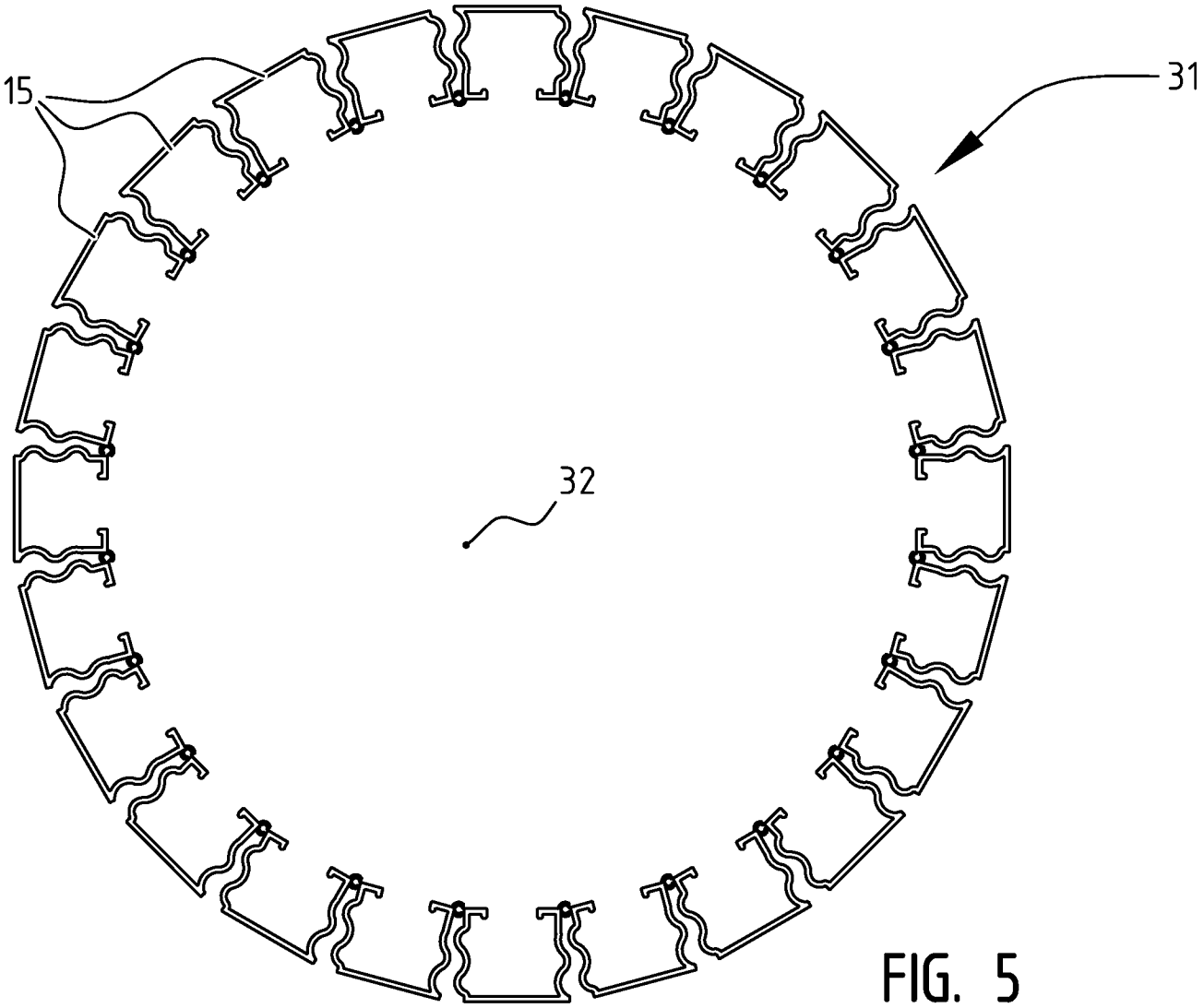
FIG. 5 is a cross section of the tubular arrangement of guiding elements of FIGS. 3 and 4.
Figure 11:
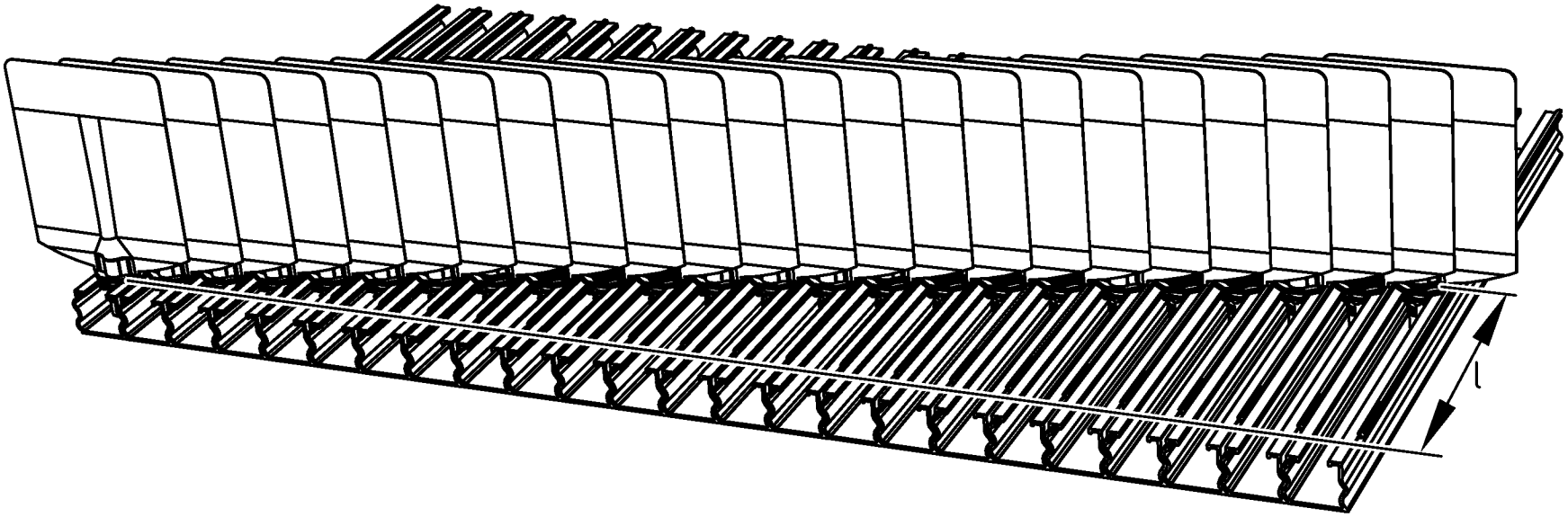
FIG. 11 is a view in perspective of the assembly of guiding elements of FIG. 10, after being unfolded to a flat arrangement.

Referring to FIGS. 2, 3A-B the first section side part 17 of the guiding means 15 is also provided with an outwardly extending flange forming a male coupling element 26. Similarly the second section side part 18 of the guiding element 15 comprises a female coupling element 27. The male and female coupling elements 26, 27 extend along at least a substantial part of the length of the guiding element 15 and are dimensioned in such a way that the male coupling element 26 of a first guiding element 15 can be inserted (FIG. 3A) into the female coupling element 27 of a second guiding element 15' to mutually connect (FIG. 3B) the first and second guiding elements. The coupling elements 26, 27 are configured to connect two or more parallel guiding elements 15, 15', while still allowing the guiding elements 15,15' to pivot ($R_1$, FIG. 3B) relative to one another. Since connected guiding elements may still be pivoted relative to each other, they can be positioned in different arrangement. For instance, the guiding elements may be positioned or folded into a tubular arrangement when guiding elements are connected to other guiding elements. This tubular arrangement is shown in FIG. 5. The guiding elements may also be unfolded by pivoting them to a generally flat arrangement wherein the guiding elements all extend in one flat plane, as can be seen in FIG. 11. The guiding elements arranged in the tubular arrangement of FIG. 5 are self-maintaining (or self-supporting) so that the guiding elements can be coupled in such a manner, that they are mutually supported and that they remain in their tubular arrangement without needing any further means. In other embodiments the guiding elements need to have a support element, for instance a sleeve or a tube, to maintain the guiding elements in their tubular arrangement. Examples of these embodiments will be described hereafter.

The female coupling element 27 may have a couple of pivot elements 30 (cf. FIG. 3B) In some embodiments of the invention there are only three pivot elements 30, one positioned close to an outer end of the guiding element 15, one positioned close to the opposite outer end and one in the centre. In other embodiments a different number of pivot elements are used. This arrangement of pivot elements enables the guiding elements to be pivoted in a smooth and stable manner.

Figure 4:
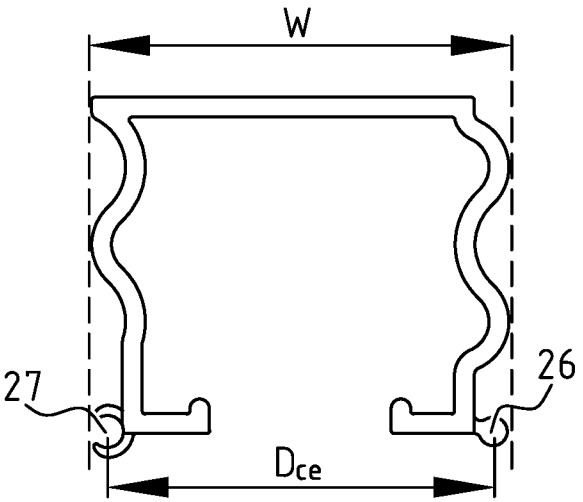
FIG. 4 is a schematic view of a cross-section of a guiding element, showing the maximum width of the guiding element and the distance between the coupling elements thereof.

FIGS. 3A,3B and 4 show that the lower ends of the side walls of the generally U-shaped guiding element are recessed relative to the upper ends of the side walls. The distance between the lower ends of the side walls is smaller than the distance between the upper ends of the side walls (i.e. the maximum width (w) of the guiding element. In case the lower ends of the side walls are provided with coupling elements, for instance the coupling elements 26,27 depicted in FIG. 4, the distance ($D_{ce}$) between the first and second coupling elements 26,27 of the guiding element is smaller than the maximum width (w) of the guiding element. As mentioned above, the width of the guiding element can be made relatively large, making it easier to properly grip the guiding element in case of handling the guiding element in a loading or unloading station, while the distance between the lower ends of the side walls (which distance determines the pitch between containers in neighbouring guiding elements) can be kept relatively small.

Figure 6:
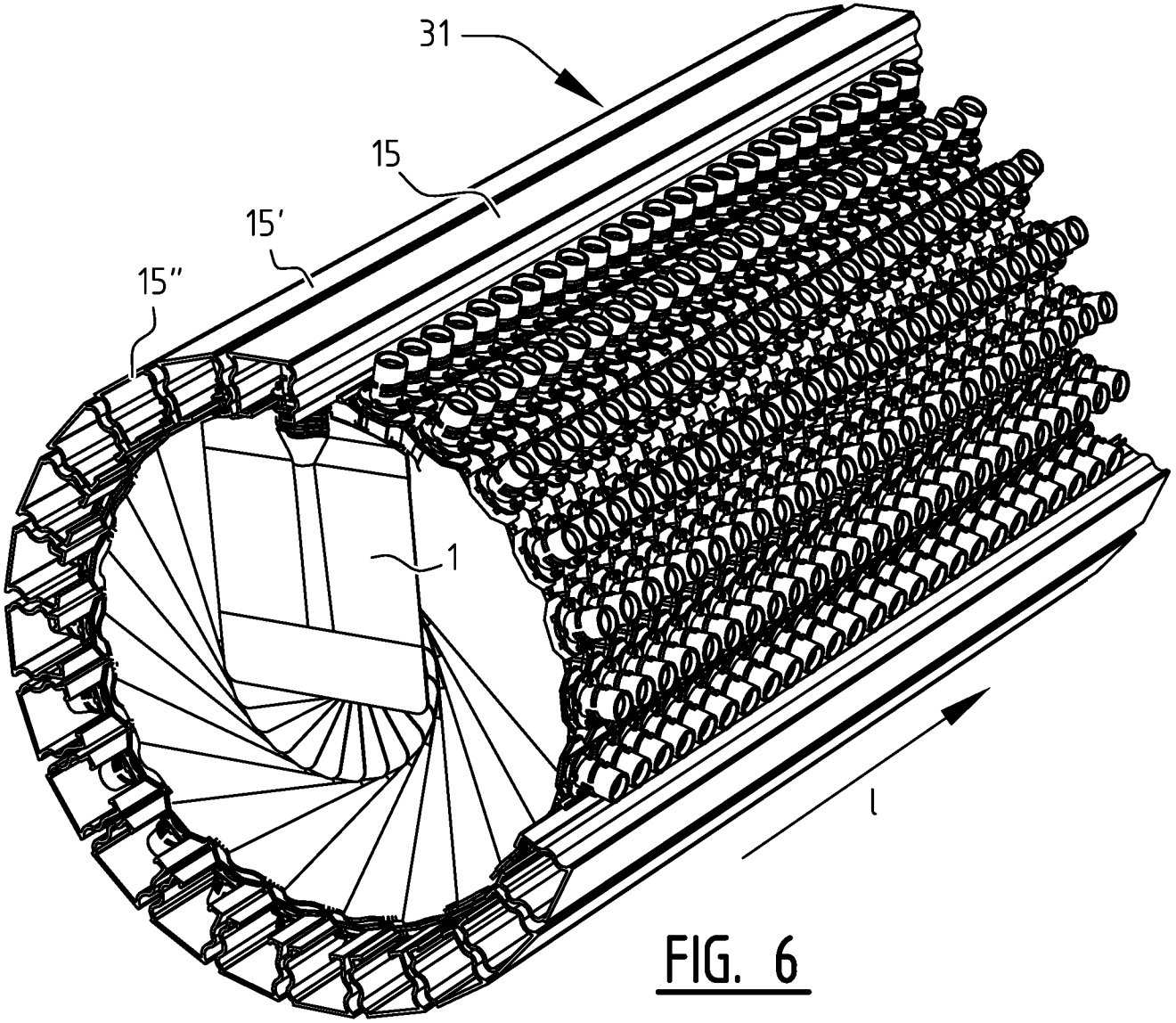
FIG. 6 is a partly cut-away view in perspective of the assembly of guiding elements in the tubular arrangement of FIG. 5, wherein the assembly is filled with a large number of containers.

FIG. 6 shows the same tubular arrangement 31 of guiding elements 15 represented in FIG. 5, but now the interior 32 of the tubular arrangement 31 is completely filled with a large number of pouches 1. FIG. 6, which is a partly cut-away view of the assembly once it has been arranged in the tubular arrangement 31 and pouches have been moved into the respective guiding elements 15, shows that the spouts 4 inserted into the tube-like arrangement extend in a generally helical trajectory along the length (l) of the guiding elements. In other words, in order to optimize the use of the space available in the interior 32 of the tubular arrangement 31, the pouches may be arranged in the tubular arrangement in angularly displaced positions.

Figure 10:
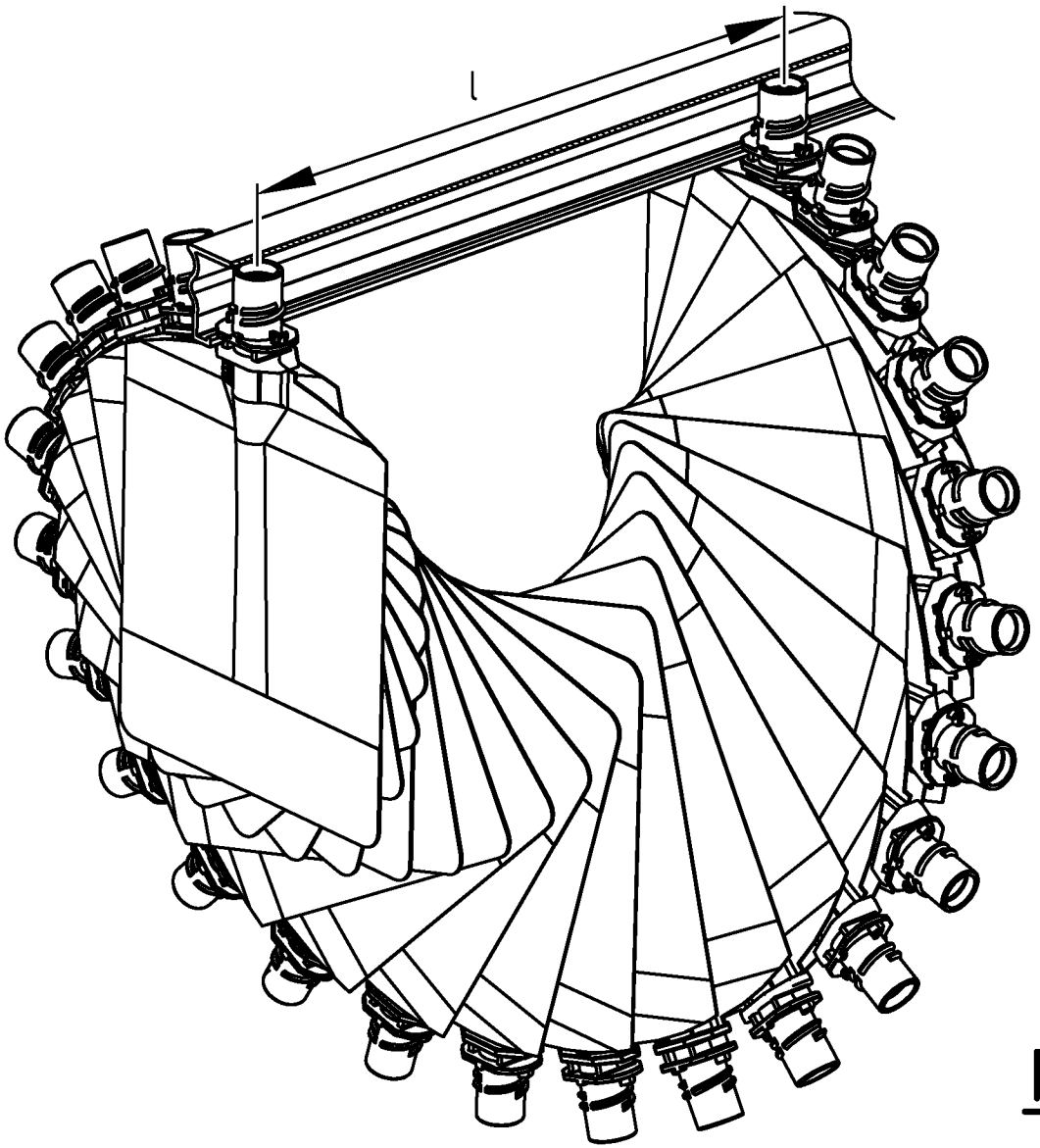
FIG. 10 is a view in perspective of a tubular arrangement of guiding elements filled with a first set of containers.

This helical trajectory can be accomplished by inserting the spout of a first pouch in a first guiding element 15, then arranging a second pouch in a partly overlapping manner in the tube-like arrangement by inserting the associated spout into a second guiding element 15'(as a non-limiting example, by inserting the spout into the neighbouring guiding element) and repeating the same until the entire interior of the tubular arrangement is filled with pouches. A further example elucidating this filling order of the tubular arrangement of guiding elements is shown in FIGS. 10 and 11. FIG. 10 shows a first "revolution" of containers extending along the inner circumference of the tubular arrangement. For clarity reasons the containers are depicted so that the distance (l) in longitudinal direction is considerable. In more practical situations the distance (l) is smaller in order to arrange as many containers as possible on the guiding element. FIG. 11 shows the guiding elements and containers of FIG. 10 when the tubular arrangement of guiding elements has been unfolded to a substantially flat arrangement.

The number of guiding elements of the tubular arrangement may vary. Generally the number of guiding elements is n, wherein n=1, 2, 3, 4 . . . . Furthermore, not all guiding elements need to be filled with containers. In embodiments of the invention only a subset of the guiding elements is selectively filled, for instance six or twelve of a total number of 24 guiding elements, depending on the shape and/or size of the pouches, for instance with a view to provide for a compact storage.

In a typical (but non-limiting) example 24 pouches per rotation (revolution) can be accommodated in the tubular arrangement. Depending on the length of the guiding elements and the dimensions of the pouches about 53 rotations can be accommodated in the tubular arrangement. This means that the storage capacity of one assembly can be as high as 1272 pouches.

Figure 13:
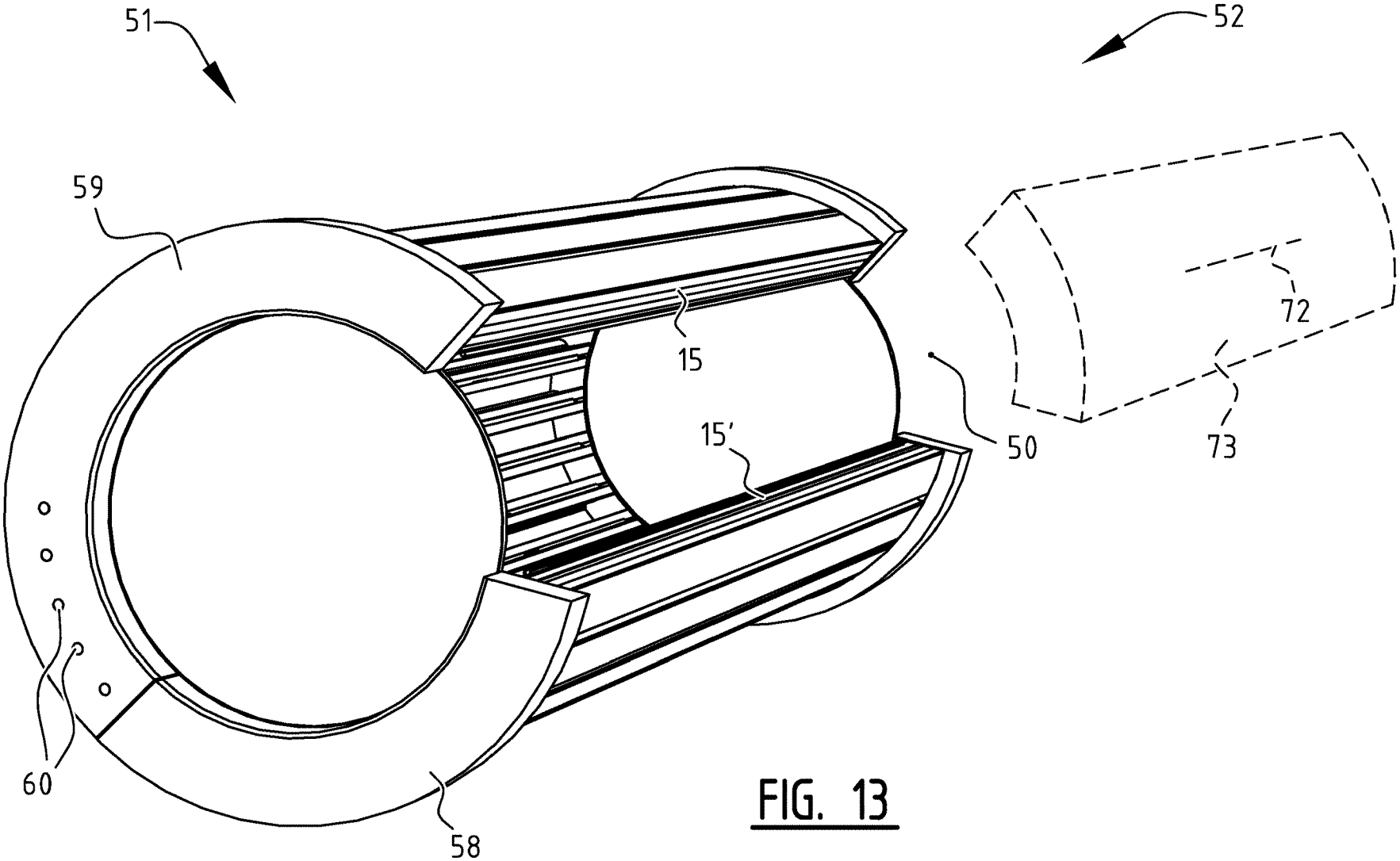
FIG. 13 is a view in perspective of an embodiment of an assembly in a substantially tubular arrangement, wherein the containers are only partly covered by the guiding elements.

However, the pouches can be arranged in the interior in alternative order as can be appreciated by the skilled person. Important is that the pouches can be moved into the guiding elements 15 in such a manner that the guiding elements 15 provide a protective cover around at least a part of the pouches. It is appreciated that in the shown embodiment the interior 32 is completely surrounded by guiding elements 15 (except of course at both outer ends thereof). However, in other embodiments one or more of the shown guiding elements 15 can be dispensed with, so that the interior 32 is only partly surrounded by guiding elements. An example of these configurations is shown in FIG. 13.

Figure 7:
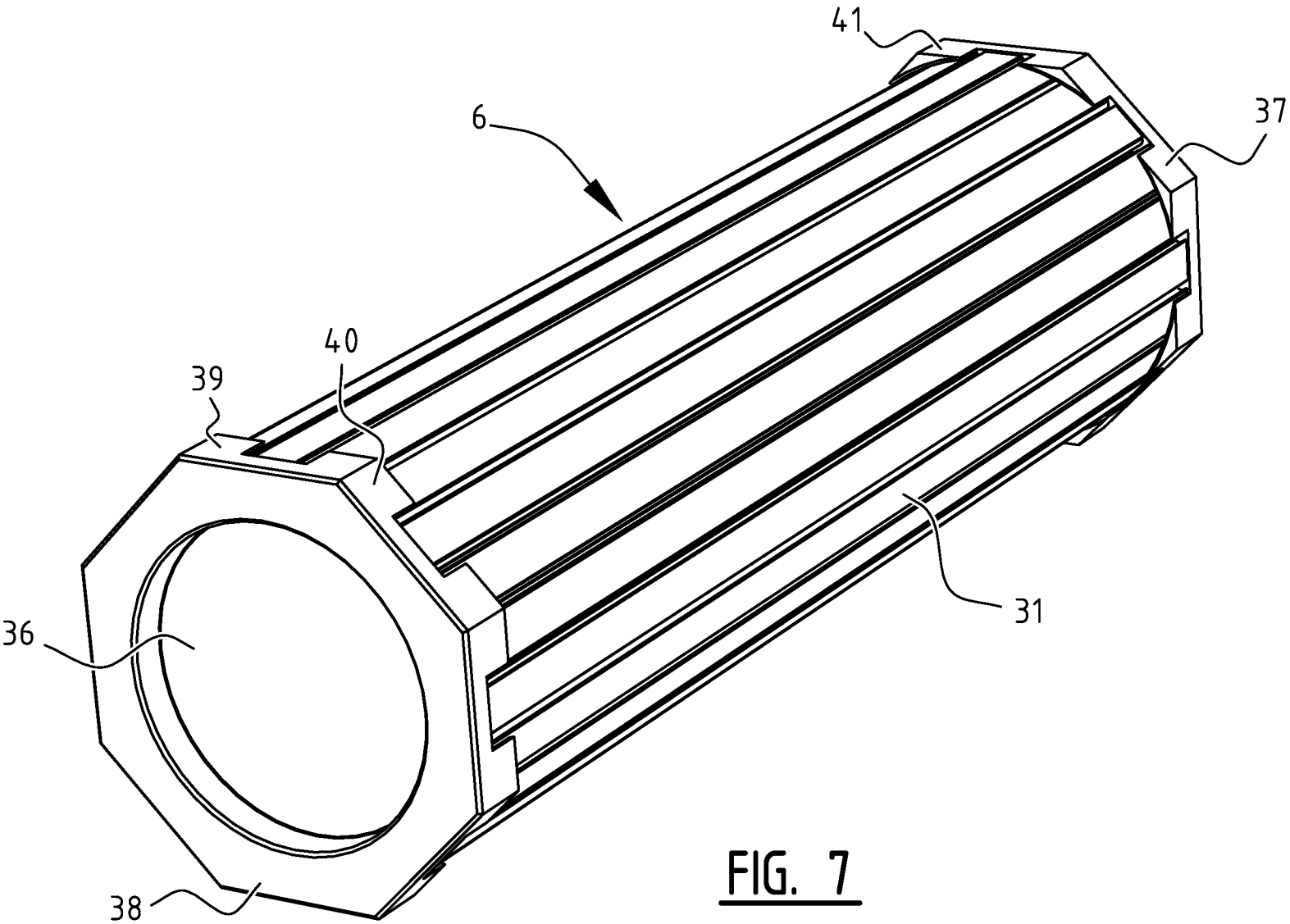
FIG. 7 is a view in perspective of a tubular arrangement of guiding elements according to FIG. 6, provided with end caps.

As mentioned above, the pouches 1 are protected by the tubular arrangement 31 of the guiding elements. The outer ends of the tubular arrangement, however, remain open so that the first few containers and the last few containers in the tubular arrangement are still uncovered in axial direction. In cases wherein additional protection of the pouches is needed, for instance when the interior of the tubular arrangement 31 should be entirely sealed off from the surroundings, cover elements, for instance the end caps 36, 37 shown in FIG. 7, can be removably attached to the outer ends of the tubular arrangement. In the embodiment shown in FIG. 7, the end caps 36, 37 are provided with clamping elements 40, 41 which allow the end caps 36, 37 to be clamped to the guiding elements.

Figure 8:
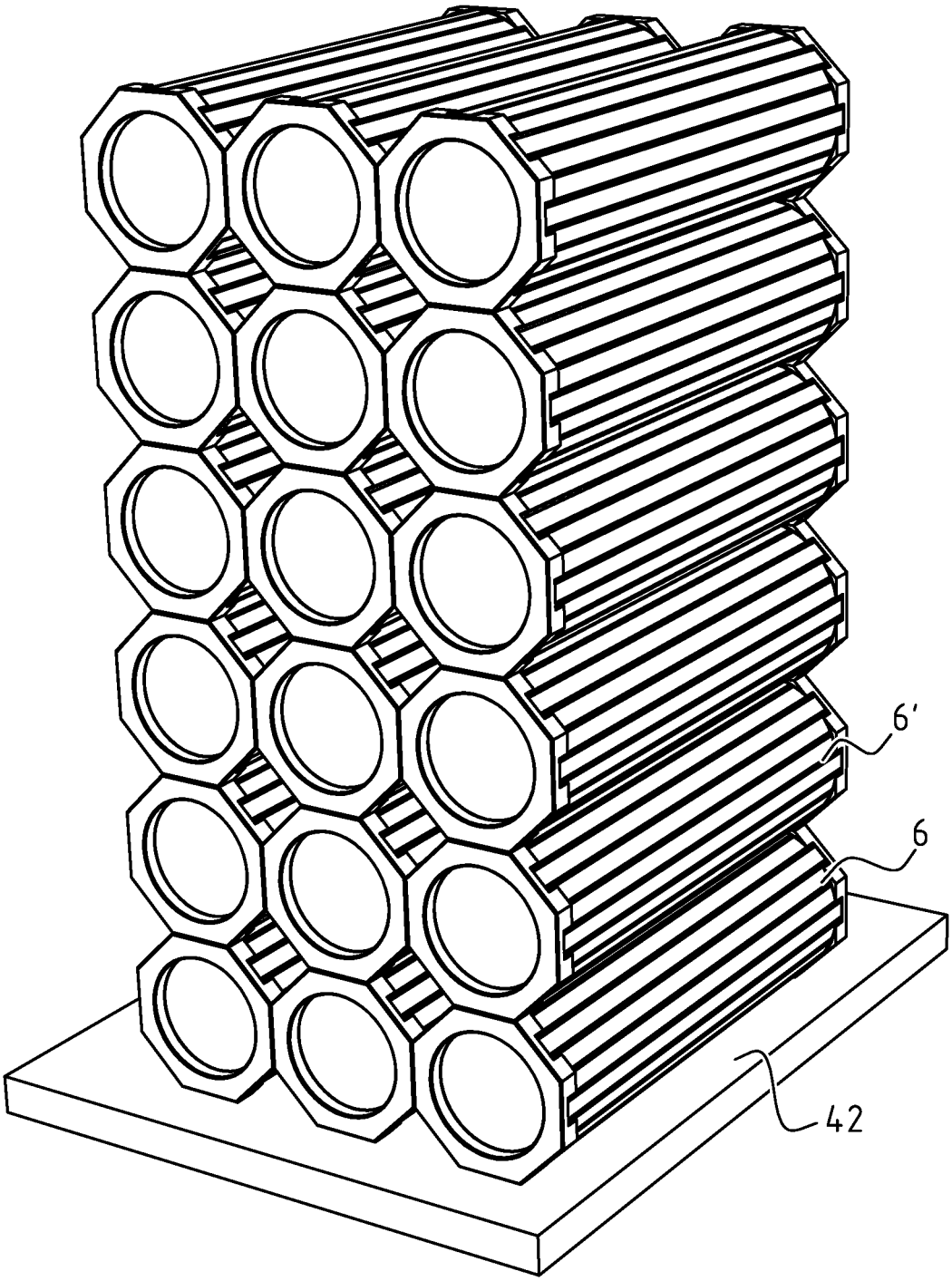
FIG. 8 is a schematic view of a possible arrangement of a number of assemblies on a pallet.

The end caps 36, 37 could have any shape or dimensions. However, in the shown embodiment, the end caps 36, 37 have at least one substantially flat side part 38 so as to enable the tubular arrangement to be supported in a stable manner on a flat surface, for instance a floor or platform of a truck. Furthermore, in further embodiments of the invention, each end cap 36, 37 also has a second substantially flat part 39. The second flat part 39 is able to carry a further tubular arrangement placed on top of the first assembly. In this manner, a number of tube-like assemblies 6,6' may be stacked (cf. FIG. 8). The stacked assembly can be supported in a stable manner on a pallet 42, so that no further stabilisation means are needed. In a typical configuration a single pallet 42 can carry an array of 5×10 (=50) assemblies and therefore as many as about 50×1272 (=63,600) pouches.

When the pouches 1 are arranged in the interior of the tubular assembly and, optionally, the end caps have been attached to completely seal off the interior 32, the assembly is ready to be stored and/or to be transported. After transportation of the assembly to its destination, for instance the factory where the pouches are filled with their content, the end caps 36, 37 can be removed and two of the guiding elements 15, 15' can be disconnected from one another. Once two of the guiding elements have been disconnected, for instance by forcing the male coupling element 26 of the first guiding element out of the female coupling element 27 of the second coupling element, the guiding elements which are still in the tubular arrangement, can be pivoted to unfold the tubular arrangement. The pouches are exposed and ready for further processing.

Figure 9:
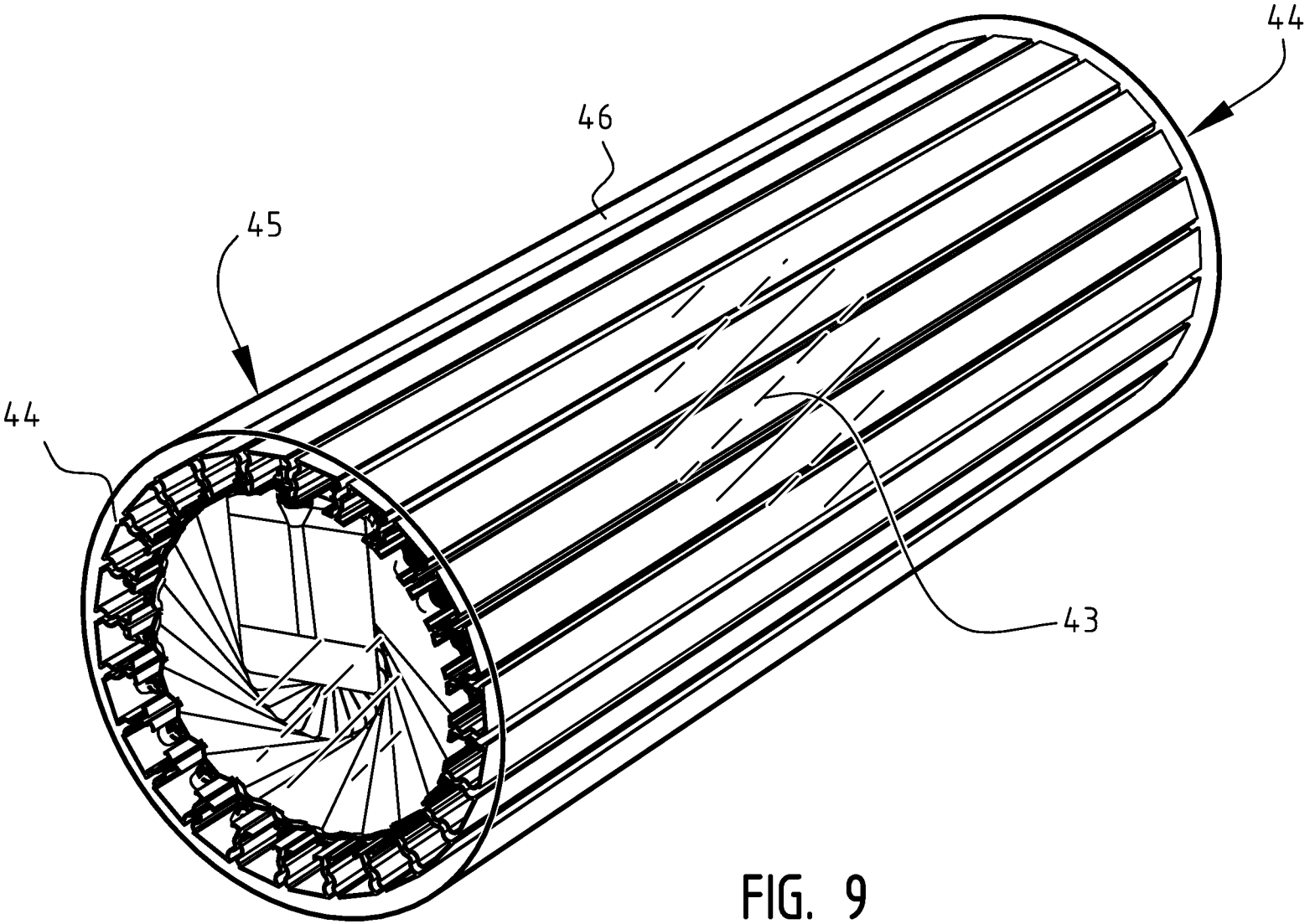
FIG. 9 is a view in perspective of a further embodiment of the assembly of guiding elements, sealed off by a shrink sleeve.

In FIG. 9 an alternative embodiment of the closure of the tubular arrangement of the assembly is shown. Instead of providing the end portions of the tubular arrangement with end caps, the entire tube-like arrangement of guiding elements is sealed by a (transparent or non-transparent) foil, for instance a shrink sleeve that may be shrunk in an oven (not shown) around the guiding elements. The shrink sleeve may cover the tubular arrangement entirely, thereby completely sealing the pouches from the surroundings. More specifically, FIG. 9 shows an embodiment wherein a sleeve 43 has been arranged around the assembly of guiding elements, for instance the assembly in its tubular arrangement 45. The sleeve is a shrink sleeve that has undergone a heat shrink process to shrink the sleeve around the assembly to fully cover the assembly. The sleeve is present around the outer side 46 of the tubular arrangement and also covers the terminal ends 44 thereof. In this manner an excellent protection of the interior of the assembly against external influences can be accomplished. In some embodiments the shrink sleeve also has a support function, namely to support the guiding elements in order to keep them in the tubular arrangement. In further embodiments first a sleeve is shrunk around the tubular arrangement and then one or more end caps are arranged around the end(s) of the tubular arrangement.

Figure 12:
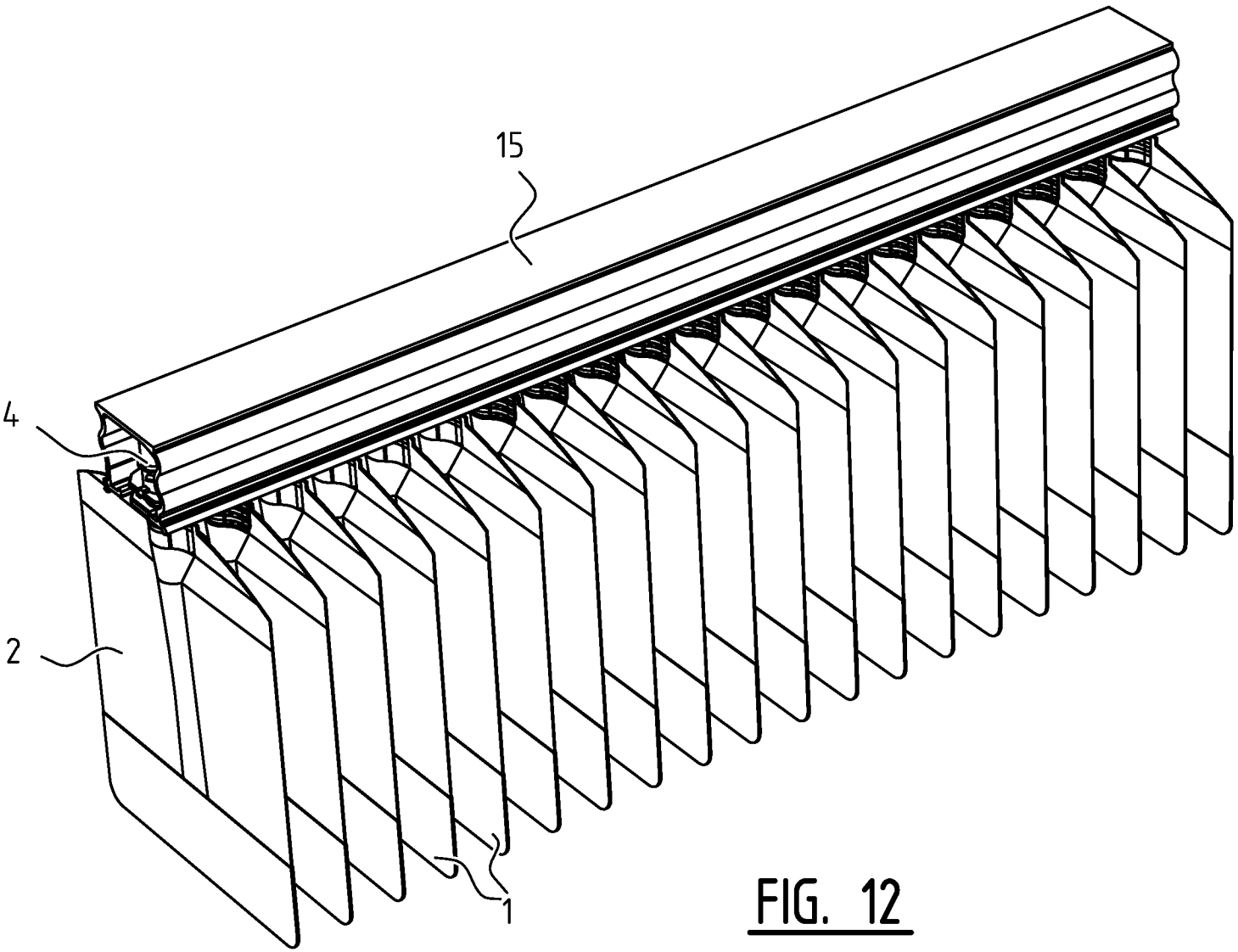
FIG. 12 is a view in perspective of one guiding element with containers, after the guiding element has been disconnected from the neighbouring guiding elements.

In FIG. 11 (in which for clarity reasons only a subset of the total number of pouches is depicted) the guiding elements are shown in an unfolded condition. The guiding elements are pivoted until they extend in a generally horizontal plane. The guiding elements may be supported by a suitable support mechanism (not shown), for instance at the beginning of the filling machine. In this position it is possible to remove the guiding elements one by one. Each guiding element may be individually transported into the feeding mechanism. The pouches may be removed by moving them one by one out of the guiding element and filled with the appropriate substance. It is to be understood that other configurations are also possible, for instance configurations wherein the guiding elements are suspended from a conveyor. The pouches in this configuration extend in a downward manner. Also in this configuration the guiding elements can be disconnected from one another one by one so that each guiding element can be made available for further processing (see FIG. 12).

FIG. 13 shows an embodiment wherein the guiding elements 15 are arranged in a substantially tubular arrangement. Unlike the previously shown tubular arrangements that define a closed circumference, the circumference defined by the guiding elements in this embodiment is open. A longitudinal opening 50 is present between the outer guiding elements 15,15'. Also in this tubular arrangement the pouches in the interior 32 still benefit from the partial coverage provided by the remaining guiding elements 15. In this example the guiding elements are kept in place by two end caps 51, 52 that are configured to be clamped along the outer ends of the guiding elements in their tubular arrangement. When the end caps 51,52 are removed, the guiding elements can be unfolded, for instance to the position shown in FIG. 11.

The end cap 51,52 may comprise a circular plate having a circumferential edge 57 along which a first end cap part 58 and a second end cap part 59 can be moved. The end cap parts may be locked to one another at several discrete positions by a locking mechanism 60. In other examples an insert (not shown) is inserted in the free opening 50 and attached to the outermost guiding elements 15,15'. The insert not only keeps the folded guiding elements in their tubular shape, but may also provide additional protection for the interior of the tubular arrangements wherein containers may have been stored.

In the longitudinal opening 50 a lid 73 may be arranged to close the tubular arrangement. The lid 73 may comprise a handle 72 to facilitate handling of the lid 73. The opening enables inspection of the interior of the tube, while the handle makes it easier to carry the assembly by hand.

FIGS. 14A and 14B show a further embodiment of the present invention. In this embodiment a number of guiding elements 100 have been attached, for instance glued, to the inner surface 101 of a flexible support 102, for instance a sheet of flexible material, such as soft PVC. The support 102 is flexible to the extent that the guiding elements 100 may be displaced between a flat arrangement (shown in FIG. 14A and the right hand side of FIG. 15) and a tubular arrangement (shown in FIG. 14B). The guiding elements 100 are interconnected indirectly by the respective portions 103 of the support 102 arranged between the guiding elements 100. No direct interconnection like the coupling elements used in the embodiment of FIGS. 2 and 3, are needed. The guiding elements 100 are generally U-shaped and are provided at their longitudinal free edges with appropriate flanges 105, 106 extending inward and providing support for the (spouts of the) containers.

FIG. 16 shows an exemplifying example of a preparation device according to the invention. The preparation device 67 in this embodiment comprises a tubular element 68, for instance made of flexible material. The tubular element 68 comprises at its inner surface 69 a number of receiving elements 70 spaced along the circumference of the tubular element and extending in an axial (longitudinal) direction. The receiving elements 70 are configured to receive a number of guiding elements (not shown). Once the receiving elements 70 have received the guiding elements, containers may be arranged in the guiding elements, for instance in the manner as described in connection with FIG. 6. After the guiding elements have been filled with containers, the preparation device 67 may be removed from the guiding elements. Due to the fact that the containers extend in the interior in an intertwined manner the guiding elements remain in their tubular arrangement, even when the preparation device has been removed completely. The tubular arrangement of guiding elements (which are not interconnected directly, at least not in the present example) may be sealed, for instance by shrinking a sleeve around the arrangement.

FIG. 17 shows an alternative embodiment of an assembly according to the invention. The assembly comprises a tube, for instance a plastic hose or hose-like element. The inner surface 62 of the tube comprises one single guiding element 63, for instance a separate guiding element connected (for instance glued) to the inner surface 62 or a guiding element formed integrally with the tubular element, for carrying a row of containers in a generally helical trajectory.

Figure 23:
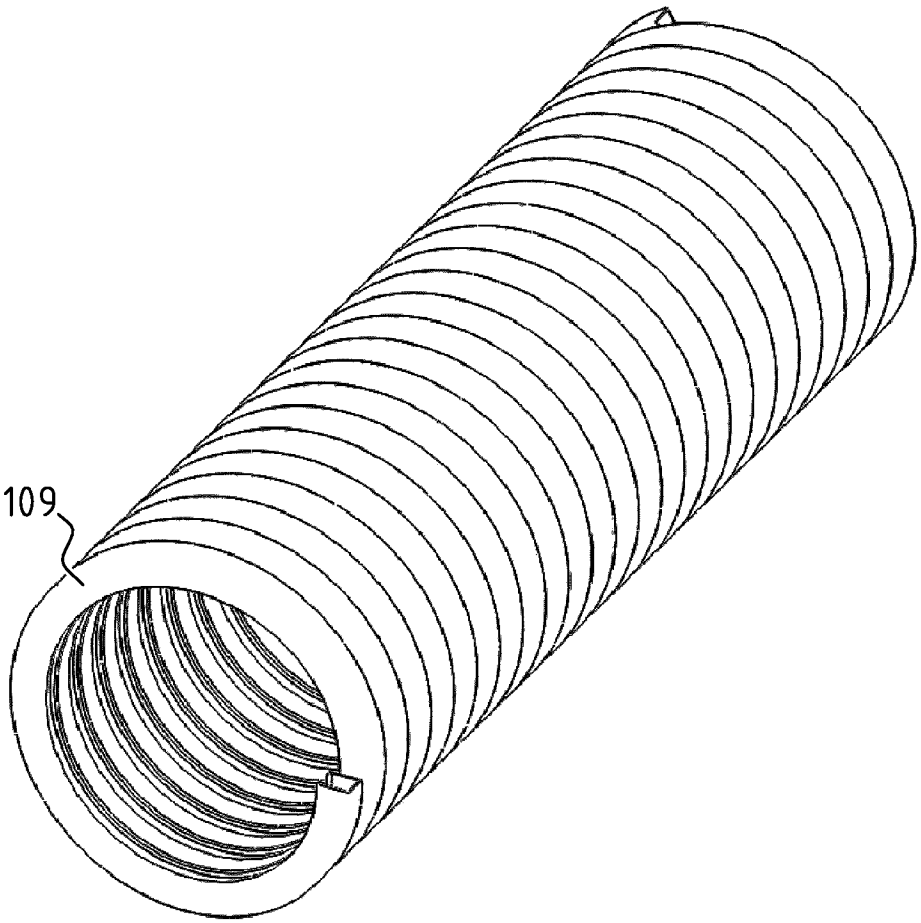

FIG. 23 shows an alternative embodiment of an assembly according to the invention. The assembly comprises a single guiding element 109 for carrying a row of containers. The single guiding element 109 has a generally helical shape forming a tubular arrangement with a guiding element providing a generally helical trajectory for the containers. In embodiments of the invention the material of the single guiding element is flexible to the extent that it may be unfolded if force is applied to it, but has the tendency to remain in the tubular shape. The tubular arrangement may be sealed, for instance by applying a sleeve around guiding element.

In a further embodiment, not shown in the figures, the tubular assembly comprises a flexible sheet at the inner side of which a number of guiding elements have been formed. The guiding elements are made of relatively stiff, non-flexible material while between individual guiding elements flexible material parts are arranged. Longitudinal edges of the flexible sheet may be connected to each other to form a tubular shape. In disconnected condition the sheet may be unfolded easily. The sheet may also be connected to one or two further sheets (each sheet provided with a number of guiding elements) to form an elongated belt or similar structure that may be easily processed by further processing equipment.

Figure 18A:
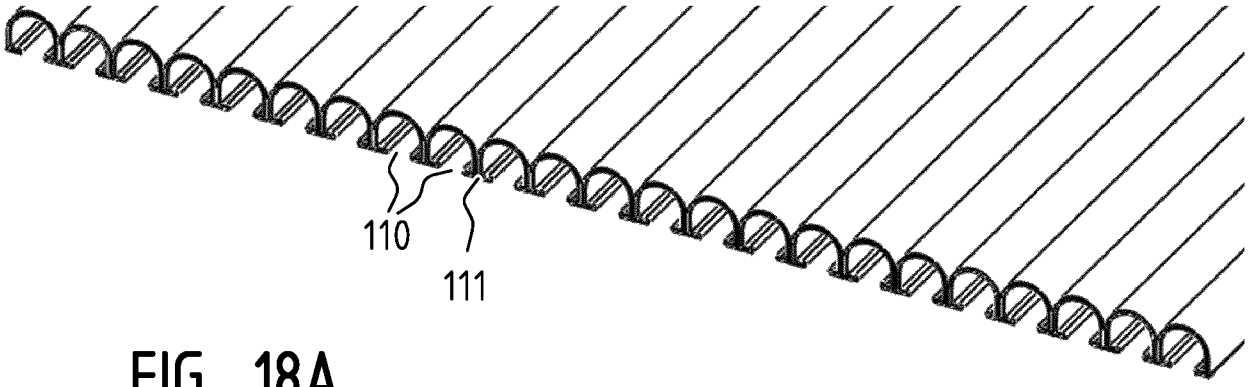
Figure 18B:
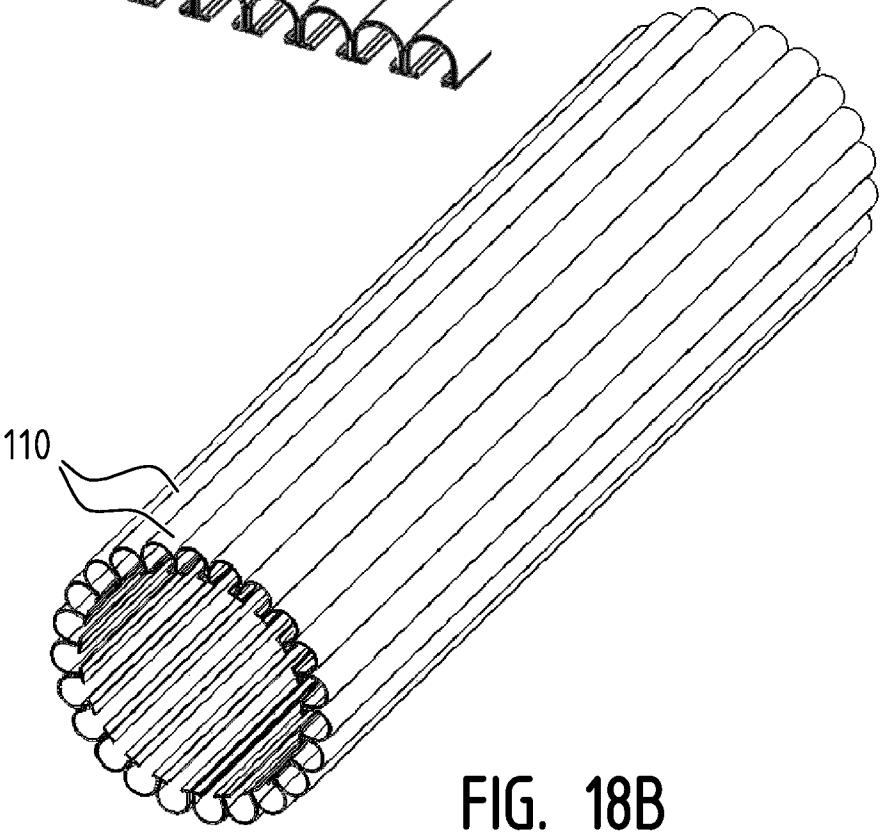

FIGS. 18A and 18B show a further embodiment of the invention. In this embodiment the individual guiding elements 110 have a generally curved shape in cross-section, for instance semi-circular, and are mutually connected, for instance by means of strips 111 of flexible material allowing the guiding elements to be pivoted relative to each other.

Figure 19:
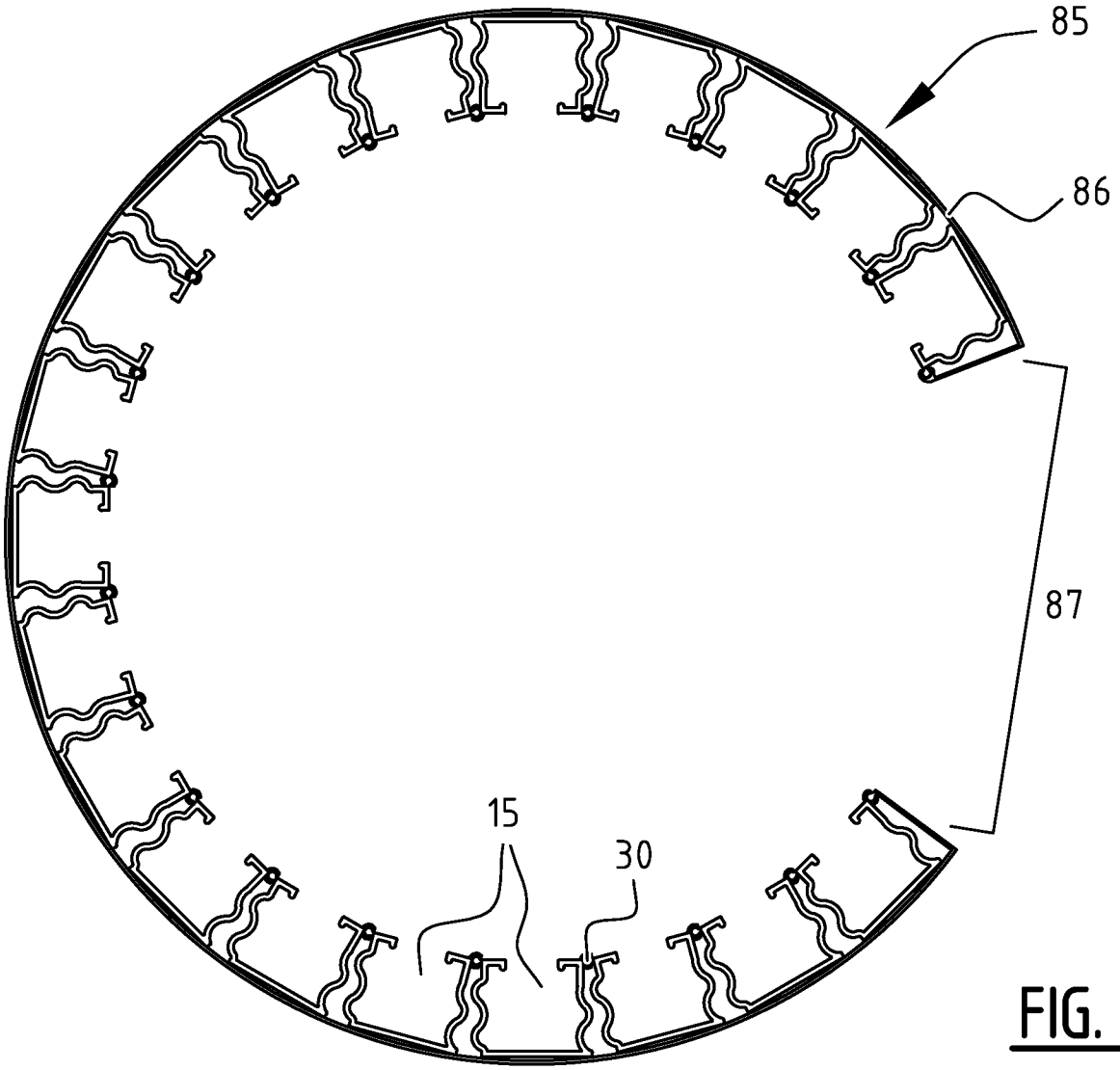

FIG. 19 shows an embodiment wherein the tubular assembly 85 comprises a number of guiding elements 15 of the type previously described, for instance in connection with the embodiments of FIGS. 2 and 3. The guiding elements 15 are interconnected using the coupling elements 30. The guiding elements are kept in a substantially tubular arrangement by a tubular element 86, for instance made of (semi-) rigid material. In the shown embodiment an elongated opening 87 is present and therefore the tubular arrangement does not form a fully closed circumference, while in other embodiments (not shown) the tubular element does form a closed circumference. Although the guiding element side walls have been depicted as having a curved side walls, it is evident to the skilled person that differently shaped guiding element parts are also conceivable, for instance in line with the guiding elements of FIGS. 14 and 15.

Figure 20:
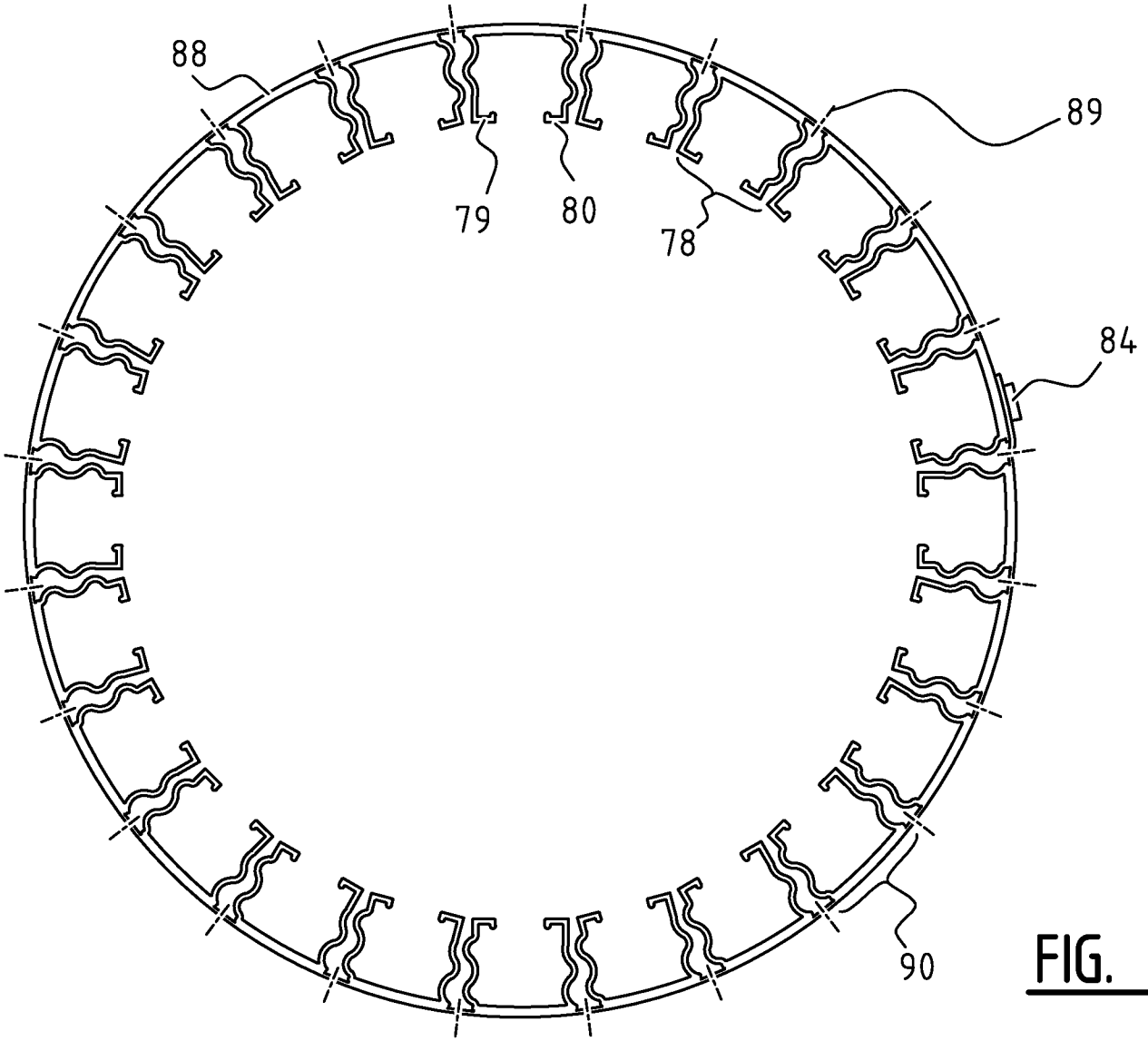

FIG. 20 is an embodiment comprising s sheet 88 of flexible or rigid material. In the sheet 88 a number of parallel locally weakened areas 89 are provided, for instance by providing lines of perforations 89 in the material of the tube sheet. This makes it possible to tear off pieces 90 of sheet material. Each individual piece of sheet material is formed with one guiding element 78 and therefore the guiding elements may be individualised, for instance when the tubular arrangement has reached its destination. In the figure an optional coupling 84 is shown. This coupling is connected to two opposing longitudinal ends of the sheet 88 and enables the tubular arrangement to be opened easily by opening the coupling 84 (and therefore without needing to tear open the tube). It is evident that this coupling can be dispensed with by replacing it with a suitable line of perforations.

Figure 21:
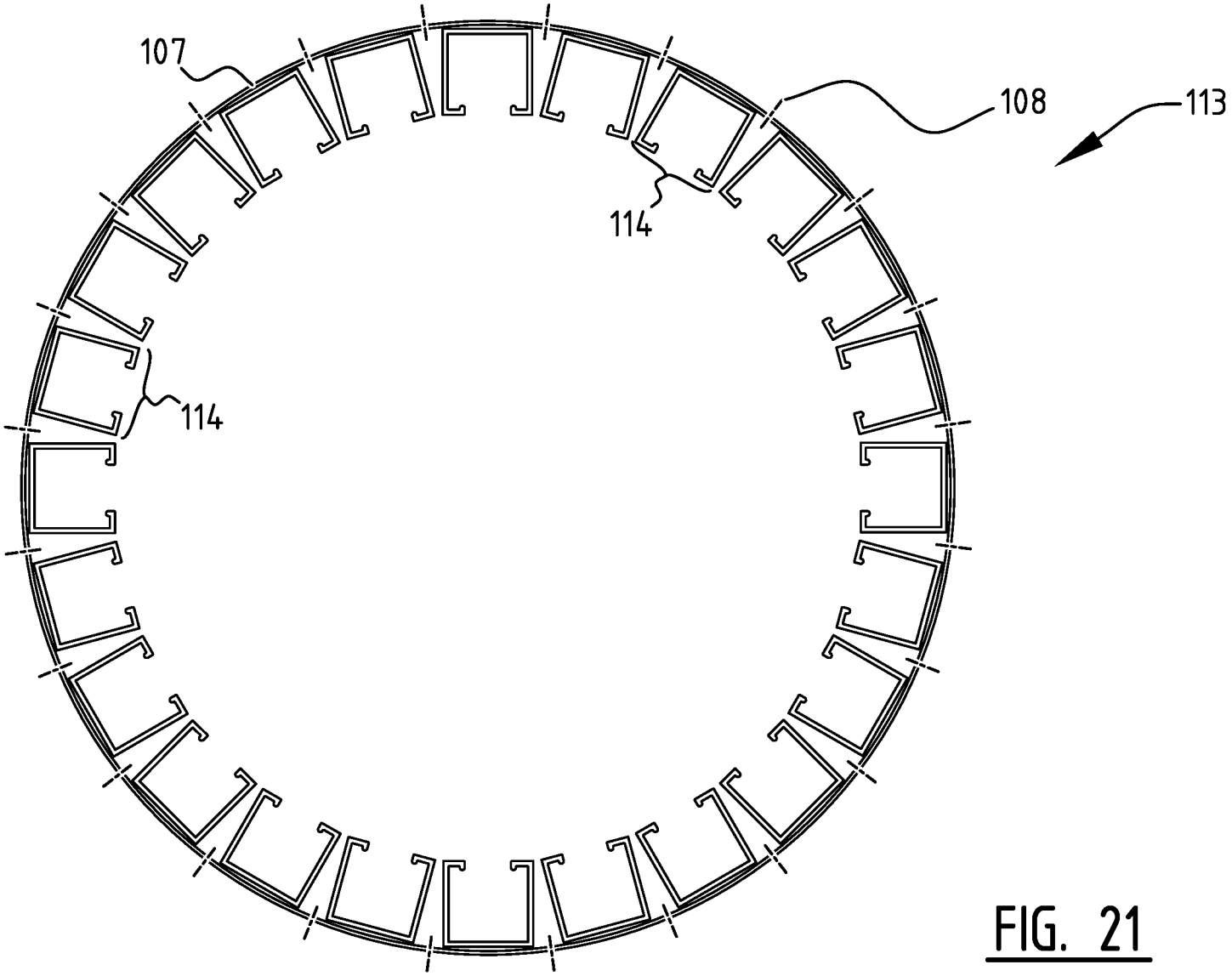

Referring to FIG. 21 an embodiment of an assembly 113 is shown wherein a number of guiding elements 114 (which have not been interconnected directly, for instance via coupling elements) are attached to a sleeve 107. The sleeve, for instance made of thin foil material, has been provided with local weak spots, such as perforations extending in a number of perforation lines 108.

Figure 22:
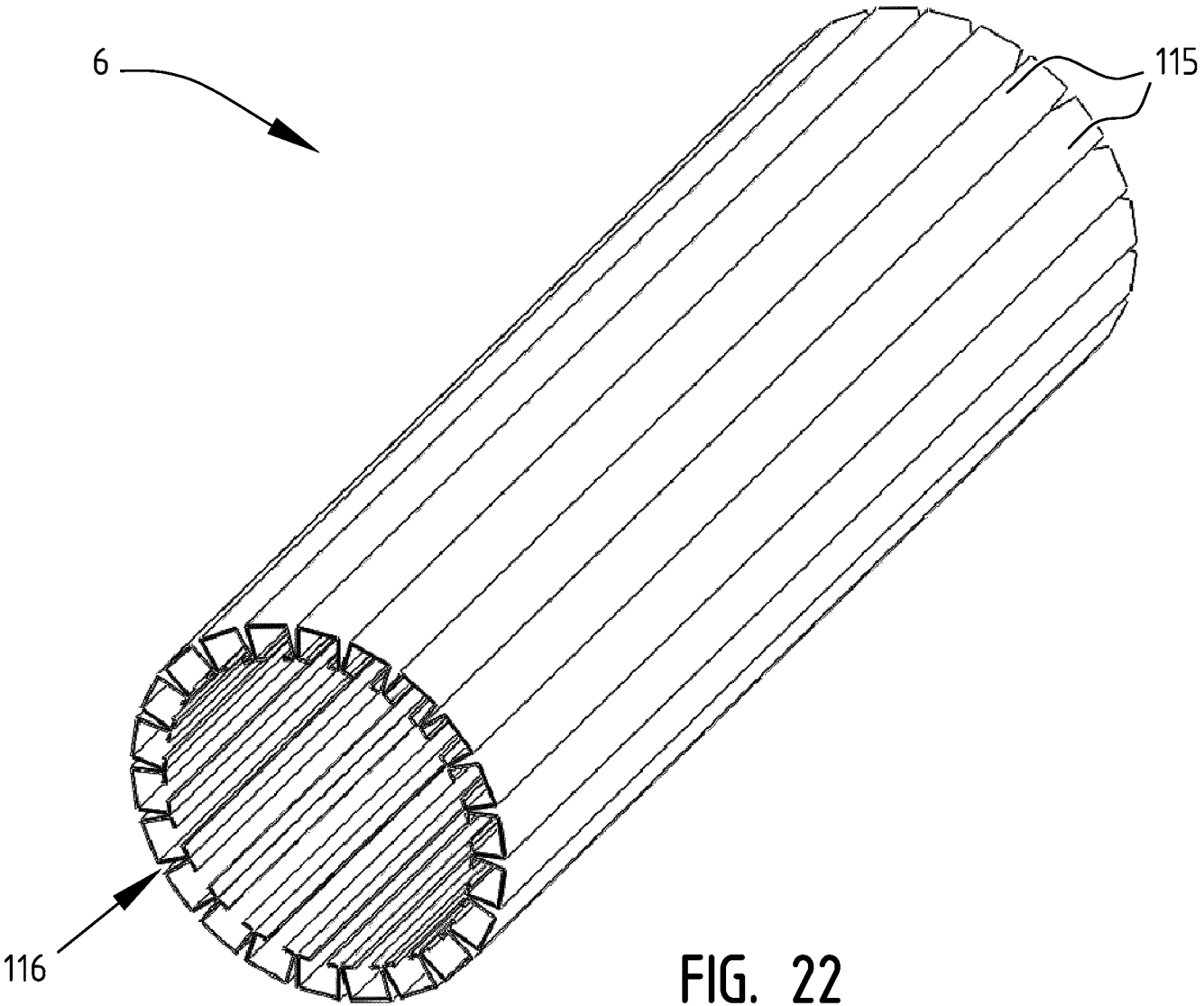

FIG. 22 shows an embodiment wherein the guiding elements 115 have been interconnected to form one single rails. For instance, the guiding elements may be welded together at the connection lines 116. The tubular arrangement may be unfolded by tearing a weld between two neighbouring guiding elements and taking the guiding elements apart.

Figure 24:
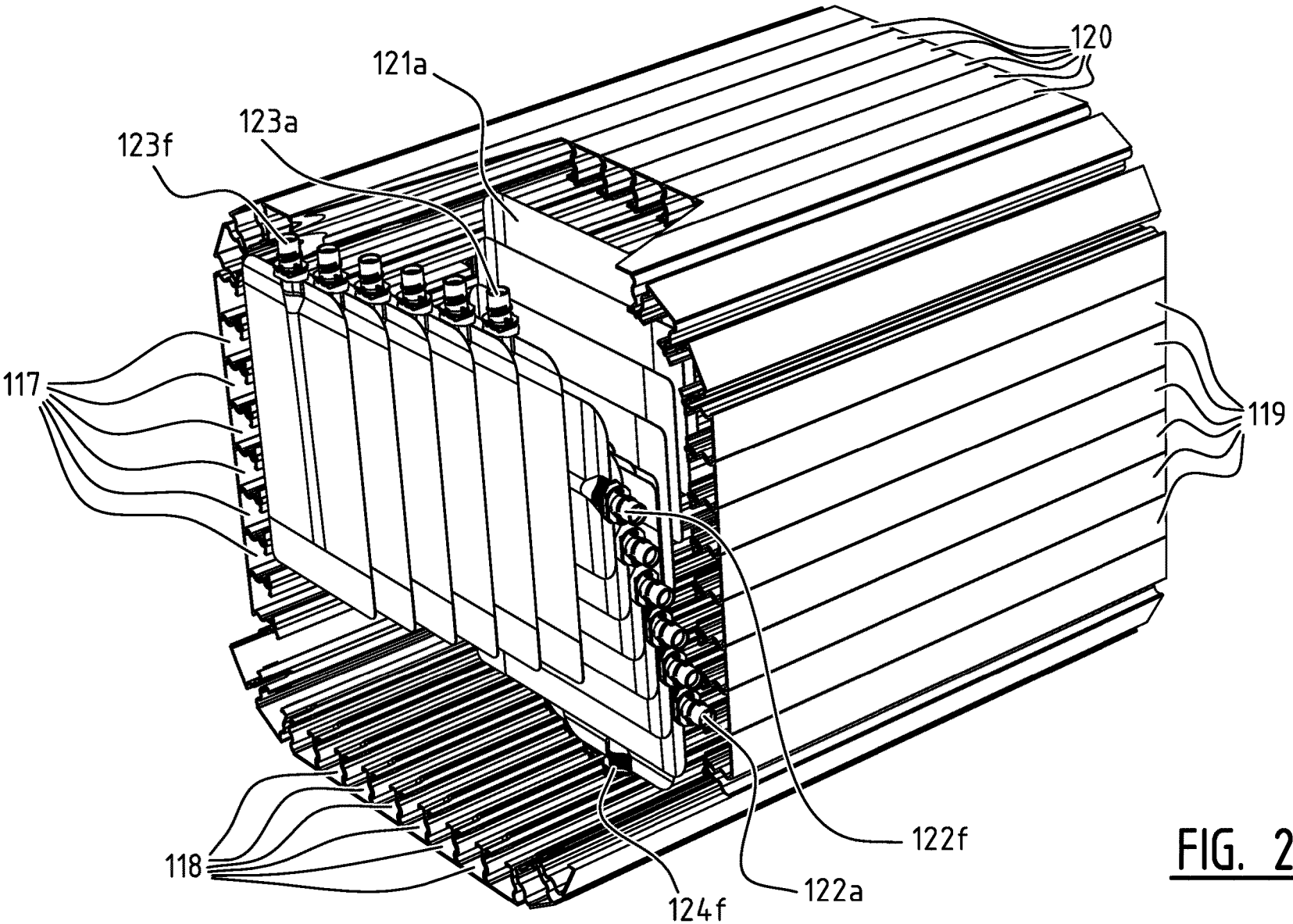

FIG. 24 is a partly cut-away view of an embodiment of the tubular arrangement of the invention in a further configuration. The embodiment corresponds to the embodiment of FIGS. 5 and 6 and comprises a number of interconnected pivotable guiding elements arranged in a tube-like shape. The tubular arrangement of FIG. 24 comprises the same guiding elements into which a number of containers have been arranged. However, unlike the situation depicted in FIGS. 5 and 6 wherein containers have been arranged in each and every guiding element, in the configuration shown in FIG. 24, containers have been arranged in a subset of all guiding elements only. More specifically, the containers 121*a*-121*f* and 122*a*-122*f* have been arranged in the six guiding elements 117 and the six guiding elements 119 forming left and right upright walls, respectively. The containers 123*a*-123*f* and 124*a*-124*f* have been arranged in the six guiding elements 120 and six guiding elements 118 forming upper and lower walls of the tubular arrangement, respectively. In the remaining guiding elements, which are positioned in the four corners of the tubular arrangement, no containers have been arranged. This configuration enables the tubular arrangement to take an essential rectangular cross-sectional shape. Due to the friction between the individual containers, the tubular arrangement is retained in its tubular shape, without a need to provide for any locking means to keep the pivotable guiding elements in position.

The present invention is not limited to the embodiments thereof described herein. The rights sought are defined by the following claims, within the scope of which numerous modifications can be envisaged.

The invention claimed is:

1. An assembly for storing a plurality of flexible containers, the assembly comprising:

a plurality of elongated guiding elements configured to carry rows of flexible containers, wherein the plurality of guiding elements are releasably coupled to one another such that they are able to be displaced into a substantially tubular arrangement and to be maintained in the substantially tubular arrangement while storing the containers in an interior formed by the tubular arrangement, wherein the plurality of guiding elements are pivotably coupled to one another such that they are pivotable relative to one another, wherein each of the plurality of guiding elements is formed by a section having a substantially U-shaped cross-section, wherein each of a longitudinal free edges of the U-shaped cross-section comprises a flange extending inwardly for guiding and supporting one or more of the plurality of flexible containers, wherein each of the longitudinal free edges of the U-shaped cross-sections has a coupling element extending outwardly for coupling with one or more neighboring guiding elements.

2. The assembly of claim 1, wherein each of the flexible containers comprises a dispensing spout, the plurality of elongated guiding elements sized receive the dispensing spout from each of the flexible containers.

3. The assembly of claim 1, wherein the plurality of guiding elements are straight elements arranged in a parallel manner.

4. The assembly of claim 1, wherein the plurality of guiding elements are configured to accommodate and guide spouts of the flexible containers, each of the plurality of guiding elements comprising a slotted carrier part configured to carry a plurality of spouts associated with a plurality of spouted pouch containers, wherein the plurality of guiding elements is arranged to allow stacking of the containers in the interior of the tubular arrangement.

5. The assembly of claim 1, wherein each of the plurality of guiding elements comprises the coupling elements configured to releasably couple and decouple abutting guiding elements by movement of one or both of the abutting guiding elements in a direction substantially perpendicular to a longitudinal direction of the guiding elements.

6. The assembly of claim 1, wherein each of the plurality of guiding elements comprises:

a first coupling element arranged at a first side; and a second coupling element at a second side, opposite the first side, wherein the first coupling element is configured to engage the second coupling element of another one of the plurality of guiding elements, wherein the first and second coupling elements are arranged at positions recessed relative to a maximum width of a respective one of the plurality of guiding elements.

7. The assembly of claim 6, wherein the distance between the first coupling element and second coupling element is smaller than the maximum width.

8. The assembly of claim 1, further comprising:

a carrier sheet, wherein the plurality of guiding elements are attached to or integrally formed with one side of the carrier sheet for mutually coupling the same, wherein the carrier sheet is made of a flexible material, wherein each of the plurality of guiding elements are generally U-shaped and comprise two opposing side walls, wherein the distance between an upper part of the side walls is larger than a distance between a lower part of the side walls.

9. The assembly of claim 1, wherein the plurality of guiding elements are pivotable between:

a storage position in which the plurality of guiding elements extend in the substantially tubular arrangement, and an operating position in which the plurality of guiding elements extend in a substantially curved or flat plane, wherein the plurality of guiding elements, when in the tubular arrangement, are configured to protect the interior of tubular arrangement.

10. The assembly of claim 1, further comprising:

a first cover element, and a second cover element, the first and second cover elements being removably attached to opposing ends of at least one of the plurality of guiding elements that are arranged in the tubular arrangement, wherein the first and second cover elements are configured to allow stable placement on a flat support surface and have a substantially polygonal cross-section.

11. The assembly of claim 1, further comprising a shrink sleeve arranged around the plurality of guiding elements.

12. A method of storing the plurality of flexible containers of claim 1, the method comprising:

positioning the at least one guiding element so as to form the substantially tubular arrangement.

13. The method of claim 12, further comprising:

mutually connecting the plurality of guiding elements; and displacing each of the plurality of guiding element relative to another into the substantially tubular arrangement.

14. The method of claim 13, further comprising:

a) positioning a first container in front of a first guiding element of the plurality of guiding elements placed in the substantially tubular arrangement;

b) guiding the first container into the first guiding element;

c) positioning a further container in front of a further guiding element;

d) guiding the further container into the further guiding element;

e) repeating the guiding of further containers into a guiding element for all containers.

15. A method of removing the plurality of flexible containers from the assembly of claim 1, the method comprising:

a) guiding one of the plurality of flexible containers from one of the plurality of guiding elements;

b) guiding a further container from another one of the plurality of guiding elements; and c) repeating the guiding of further containers from a guiding element until all containers have been removed.

* * * * *